US010076145B2

(12) United States Patent
Harrell et al.

(10) Patent No.: US 10,076,145 B2
(45) Date of Patent: Sep. 18, 2018

(54) CLAMPING DEVICE

(71) Applicant: Steven J. Harrell, Philadelphia, PA (US)

(72) Inventors: Steven J. Harrell, Philadelphia, PA (US); Eric L. Canfield, Downingtown, PA (US); Scott J. Soma, Media, PA (US)

(73) Assignee: Steven J. Harrell, Philadelphia, PA (US)

( * ) Notice: Subject to any disclaimer, the term of this patent is extended or adjusted under 35 U.S.C. 154(b) by 22 days.

(21) Appl. No.: 15/462,352

(22) Filed: Mar. 17, 2017

(65) Prior Publication Data

US 2017/0265546 A1 Sep. 21, 2017

Related U.S. Application Data

(60) Provisional application No. 62/310,246, filed on Mar. 18, 2016.

(51) Int. Cl.
*A41F 1/00* (2006.01)

(52) U.S. Cl.
CPC ..... *A41F 1/002* (2013.01); *A41F 1/008* (2013.01)

(58) Field of Classification Search
CPC ..... A41F 1/002; A41F 1/008
See application file for complete search history.

(56) References Cited

U.S. PATENT DOCUMENTS 3,266,112 A * 8/1966 Heckman ..... A44B 19/16 215/316
4,197,618 A * 4/1980 Bourguignon ..... A41F 1/002 24/303
4,941,236 A * 7/1990 Sherman ..... A44C 5/2071 24/265 WS
6,062,630 A * 5/2000 Taylor ..... B60J 1/2011 296/107.07
6,301,754 B1 * 10/2001 Grunberger ..... A41F 1/002 24/303
7,320,158 B2 * 1/2008 Deto ..... A41F 1/002 24/303
7,409,730 B2 8/2008 Boos
7,451,530 B2 * 11/2008 Meager ..... A44B 19/16 24/399
7,574,780 B2 * 8/2009 Meager ..... A44B 19/16 24/399
9,210,953 B2 12/2015 Horton
(Continued)

OTHER PUBLICATIONS

Website—http://dappered.com/2012/05/how-to-show-less-chest-hair/—Secret Button—publication date: May 31, 2012.

*Primary Examiner* — David M Upchurch
(74) *Attorney, Agent, or Firm* — Volpe and Koening, P.C.

(57) ABSTRACT

A clamping device including a first and second magnet is provided. The first magnet includes predetermined first and second side surface areas, and a first friction element on least one of the first and second side surface areas. The second magnet includes predetermined third and fourth side surface areas, and a second friction element on at least one of the third and fourth side surface areas. The first and second friction elements of the first and second magnets are arranged opposite to each other and define a clamping area between the first and second magnets.

19 Claims, 19 Drawing Sheets

(56) References Cited

U.S. PATENT DOCUMENTS

| | | | | |
|---|---|---|---|---|
| 2010/0031476 | A1* | 2/2010 | Coldiron | A44B 15/005 24/3.12 |
| 2011/0041294 | A1* | 2/2011 | Ehring | H01F 7/0263 24/303 |
| 2011/0173740 | A1 | 7/2011 | Franklin | |
| 2012/0204308 | A1 | 8/2012 | Pascuzzi et al. | |
| 2014/0173809 | A1 | 6/2014 | Partsch, IV | |
| 2015/0135399 | A1 | 5/2015 | O'Donnell | |
| 2015/0201712 | A1 | 7/2015 | Keller | |
| 2015/0216252 | A1 | 8/2015 | Wiens | |

* cited by examiner

CLAMPING DEVICE

INCORPORATION BY REFERENCE

This application claims the benefit of U.S. Provisional Application 62/310,246 filed on Mar. 18, 2016, which is incorporated by reference as if fully set forth.

FIELD OF INVENTION

This application is generally related to a clamping device and is more particularly related to a magnetic clamping device.

BACKGROUND

Clamping devices are generally known. Known clamping devices can provide permanent fixing of a clamped element in a desired position. Other clamping devices can provide movable clamping elements that can be easily positioned and removed by a user. These clamping devices generally cause deformation of the clamped material to achieve clamping, or do not provide sufficient strength to reliably hold a clamped element in a desired position.

Clamping devices can be used with garments and clothing accessories. For example, button-up shirts typically do not have a uniform spacing pattern between different brands, designers, sizes, etc. A v-shaped neckline for a shirt is set by the buttoning or unbuttoning of the buttons of the shirt. Typically, an adjustment of the v-shaped neckline of a shirt may occur depending on a social situation, wearer's mood, or other factors. The arbitrary placement of buttons on a shirt generally makes it difficult to achieve a desired v-shaped neckline. It is desirable to provide a clamping device that allows a user to set and maintain the location of a clamped material.

It would be desirable to provide a clamping device that is freely positionable, does not mar or damage a clamped material, and provides reliable clamping force to retain the clamped material in a desired position.

SUMMARY

A clamping device including a first magnet and a second magnet is provided. The first magnet has predetermined first and second side surface areas and a first friction element on least one of the first and second side surface areas. The second magnet has predetermined third and fourth side surface areas, and a second friction element on at least one of the third and fourth side surface areas. The first friction element of the first magnet and the second friction element of the second magnet are arranged opposite to each other and define a clamping area between the first magnet and the second magnet.

In one embodiment, the friction elements are tines. The tines permit compression of a clamped material to grip the clamped material, which provides increased strength and reduces the chances of the clamping device becoming unclamped. The tines increase the requisite lateral force necessary to unclamp the clamping device.

In another embodiment, the clamping device includes a plurality of magnets. The plurality of magnets preferably includes more than two magnets. Stacking the magnets increases the strength of the clamping device, while the tines ensure that the additional stacked magnets cannot slide away from each other. In this embodiment, the clamping device is infinitely stackable, i.e. it is possible to continuously add magnets until the requisite strength of the clamping device is achieved. Stacking magnets on both sides of a clamped material increases the magnetically attractive force between the two stacks of magnets, thereby increasing the overall clamping force of the clamping device.

BRIEF DESCRIPTION OF THE DRAWINGS

The following Detailed Description will be understood when read in conjunction with the appended drawings wherein.

DETAILED DESCRIPTION OF THE PREFERRED EMBODIMENTS

Figure 1A:
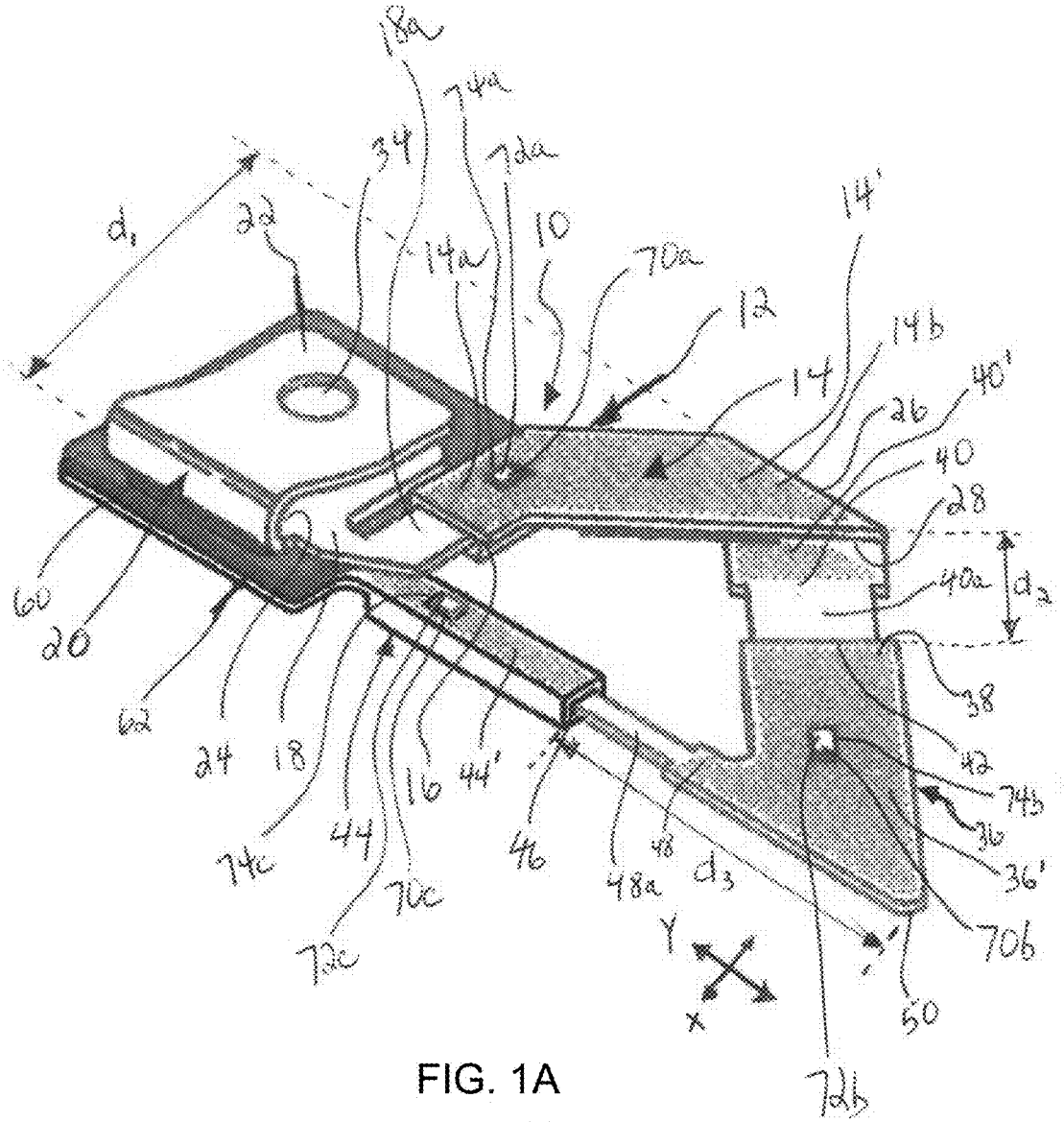
FIG. 1A shows a perspective view of a garment device according to a first embodiment in an extended state.

FIGS. 1A-1D illustrate a first embodiment of a garment closing device 10. The garment closing device 10 includes a body 12 having a first arm 14 and a first sleeve 16. As shown in FIGS. 1A-1D, the body 12 preferably has a generally triangular profile. The first arm 14 includes a first portion 18 that is slidably received within the first sleeve 16. The first sleeve 16 is dimensioned to allow for slidably adjusting the first portion 18 with respect to the first sleeve 16. The first portion 18 includes a first clip 20 having a first bend 22 that bends forwards with respect to the first arm 14 to define a first gap 24. The first arm 14 includes a second bend 26 that bends backwards with respect to the first arm 14 to define a second gap 28. The second bend 26 is preferably at an opposite end 14*b* of the first arm 14 from an end 14*a* of the first arm 14 including the first bend 22. The first bend 22 is dimensioned to grip a first portion 30 of a garment and the second bend 26 is dimensioned to grip a second portion 32 of a garment. Once installed, the first portion 30 of the garment is sandwiched between the first bend 22 and the second portion 32 of the garment is sandwiched between the second bend 26. The first portion 30 and the second portion 32 of the garment are preferably interfacing plackets of a single shirt. The first portion 30 of the garment can either be a button placket or a buttonhole placket of a shirt. The second portion 32 of the garment can either be a button placket or a buttonhole placket of a shirt.

In the embodiment shown in FIGS. 1A-1D, the first clip 20 of the first portion 18 includes a dimpled portion 34. The dimpled portion 34 provides an improved gripping configuration for the first portion 30 of the garment since the dimpled portion 34 contacts the first portion 30 of the garment once the garment closing device 10 is attached to the first and second portions of the garment 30, 32. The dimensions of the dimpled portion 34 can be varied to provide increased contact between the dimpled portion 34 and the first portion 30 of the garment. The first bend 22 and the second bend 26 each preferably define gaps 24, 28 having a clearance of 1/32", which corresponds to a thickness of an average placket for a dress shirt. The dimensions of the bends 22, 26 are selected to provide a reliable gripping configuration for an average-sized placket. The dimpled portion 34 can include some resiliency to provide a narrower gap to provide additional gripping ability of the first portion 30 of the garment.

Figure 1B:
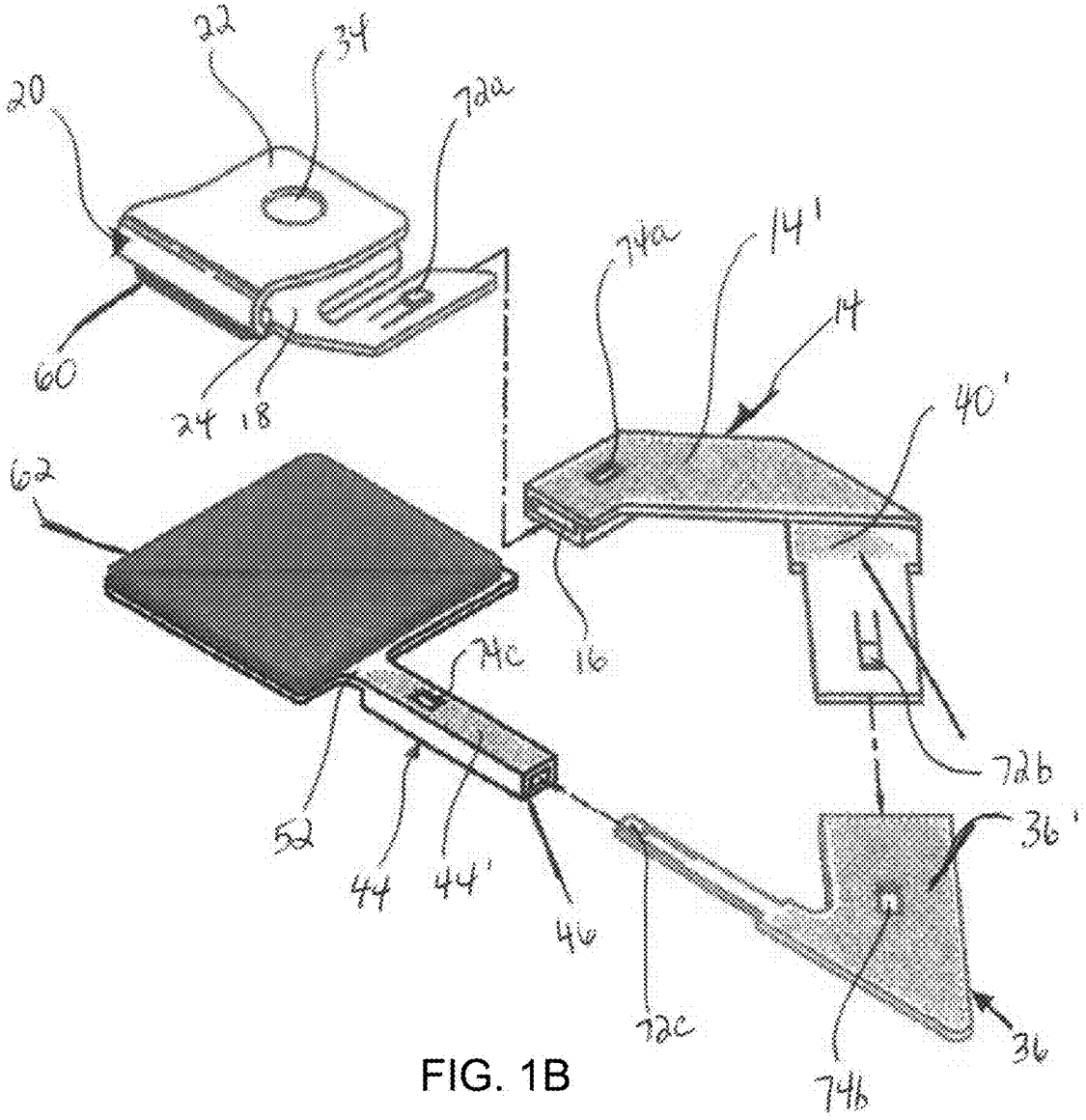
FIG. 1B shows an exploded perspective view of the garment device of FIG. 1A.
Figure 1C:
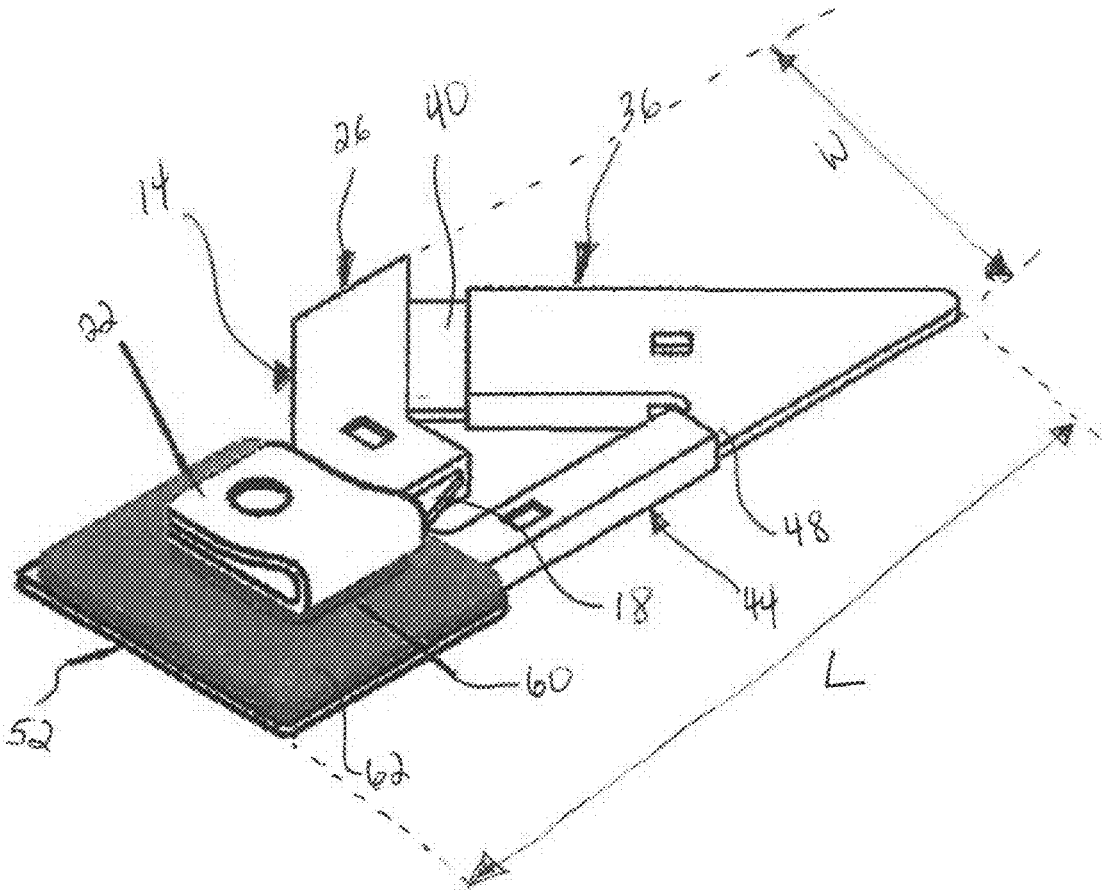
FIG. 1C shows a perspective view of the garment device of FIGS. 1A and 1B in a contracted state.

As shown in FIGS. 1A-1C, the first portion 18 of the first arm 14 is slidably received within the first sleeve 16 such that a first distance (d1) between the first bend 22 and the second bend 26 is adjustable. This adjustment of a length of the first arm 14 allows the overall lateral size of the device 10 to be adjustable, as shown in the lateral direction (X) in FIG. 1A. FIG. 1A shows the first portion 18 in an extended position, such that an extension 18*a* of the first portion 18 is visible and outside of the first sleeve 16. FIG. 1C shows the first portion 18 in a contracted position such that the extension 18*a* of the first portion 18 is slid within the first sleeve 16 and not visible.

As shown in FIGS. 1A-1D, the body 12 of the device 10 includes a second arm 36 having a second sleeve 38, which is similar to the first sleeve 16 of the first arm 14. The first arm 14 includes a second portion 40 that is slidably received within the second sleeve 38 of the second arm 36. A second distance (d2) between an end 42 of the second sleeve 38 and the second bend 26 is adjustable.

As shown in FIGS. 1A-1D, the body 12 of the device 10 includes a third arm 44 with a third sleeve 46. The second arm 36 includes a second portion 48 that is slidably received within the third sleeve 46 of the third arm 44. A third distance (d3) is adjustable between a corner 50 of the second arm 36 and the third sleeve 46 of the third arm 44.

Figure 1D:
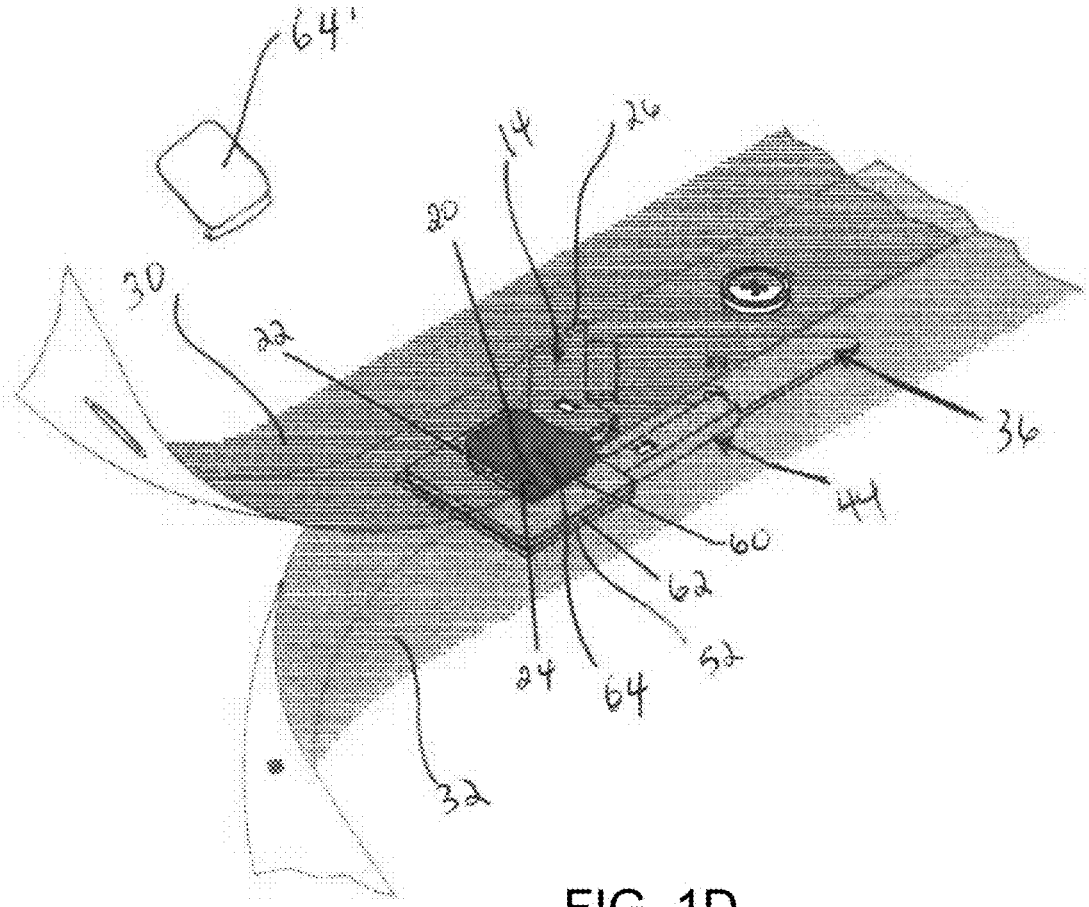
FIG. 1D shows a perspective view of the garment device of FIGS. 1A-1C in an installed state on a garment.

The third arm 44 includes a third portion 52 facing the first bend 22 of the first arm 14. In an assembled condition, the third portion 52 overlaps with the first bend 22 of the first arm 14, as shown in FIGS. 1A, 1C, and 1D. The first bend 22 of the first arm 14 includes a first magnet 60 and the third portion 52 of the third arm 44 includes a second magnet 62. In an assembled state, the first magnet 60 and the second magnet 62 are aligned in the lateral direction (X) and longitudinal direction (Y) such that the first magnet 60 and the second magnet 62 overlap with each other and provide a magnetic attraction to each other. The magnetic attraction between the first magnet 60 and the second magnet 62 helps to retain the device 10 in a desired position with respect to the first portion 30 and the second portion 32 of the garment. As shown in FIGS. 1A-1D, the second magnet 62 preferably has a larger surface area such that even when the arms 14, 36, 44 are in the extended position or the contracted position. The larger surface area of the second magnet 62 ensures overlap of the first magnet 60 and the second magnet 62 regardless of whether the arms are in the extended or contracted positions.

Adjustment mechanisms 70*a*, 70*b*, 70*c* are provided on each of the arms 14, 36, 44 and include biased locking pins 72*a*, 72*b*, 72*c* and openings 74*a*, 74*b*, 74*c* dimensioned to receive the biased first locking pin 72*a*, 72*b*, 72*c*. The locking pins 72*a*, 72*b*, 72*c* can be depressed by a user such that the locking pins 72*a*, 72*b*, 72*c* are recessed within the openings 74*a*, 74*b*, 74*c*, and the first portion 18 of the first arm 14 can be slid with respect to the first sleeve 16, the second portion 40 of the first arm 14 can be slid with respect to the second sleeve 38 of the second arm 36, and the second portion 48 of the second arm 36 can be slid with respect to the third sleeve 46 of the third arm 44. The first adjustment mechanism 70*a* allows the first bend 22 to move outward in the lateral direction (X) with respect to the second bend 26 such that the device 10 can be arranged on a larger garment. The second adjustment mechanism 70*b* allows movement of the second arm 36 both in an outward lateral direction (X) and a downward longitudinal direction (Y). The third adjustment mechanism 70*c* allows movement of the second arm 36 in the downward longitudinal direction (Y). The extended position of each of the adjustment mechanisms 70*a*, 70*b*, and 70*c* is shown in FIG. 1A. In FIG. 1A, the extension 18*a* of the first portion 18 is visible and outside of the first sleeve 16 of the first arm 14, an extension 40*a* of the second portion 40 of the first arm 14 is visible and outside of the second sleeve 38 of the second arm 36, and an extension 48*a* of the second portion 48 of the second arm 36 is visible outside of the third sleeve 46 of the third arm 44. In FIG. 1C, the device 10 is in a contracted state and the extension 18*a* of the first portion 18 is slide into the first sleeve 16 of the first arm 14, the extension 40*a* of the second portion 40 of the first arm 14 is slide into the second sleeve 38 of the second arm, and the extension 48*a* of the second portion 48 of the second arm 36 is slid within the third sleeve 46 of the third arm 44.

The adjustment mechanisms 70*a*, 70*b*, 70*c* allow the overall width (W) and overall length (L) of the device 10 to be modified as shown in FIG. 1C. FIG. 1C shows the contracted position in which the length (L) and width (W) of the device 10 is smallest. In the extended state shown in FIG. 1A, the length (L) and width (W) are greater than the length (L) and width (W) of FIG. 1C. One of ordinary skill in the art would recognize from the present application that alternative forms of adjustment mechanisms could be used, such as a telescoping arm, friction fitted sleeve and arm, or other type of spring loaded extension element.

As shown in FIG. 1D, a decorative plate 64 can be provided on a front face of the first bend 22. The decorative plate 64 can include any variety of colors to match the color of a garment, or can include ornamental designs, similar to a lapel pin. A secondary decorative plate 64' is also illustrated in FIG. 1D. The decorative plates 64, 64' are interchangeable and can be snapped or otherwise selectively fastened onto the first bend 22.

As shown in FIGS. 1A and 1B, friction surfaces 14', 36', 40', 44' are arranged on front surfaces of the first arm 14, second arm 36, third arm 44, and second portion 40 of the first arm 14. These friction surfaces 14', 36', 40', 44' provide increased friction for the garment compared to an adjacent surface, such as an adjacent smooth surface of the extensions 18*a*, 40*a*, 48*a*. The body 12 of the device 10 is generally formed from a plastic or sheet metal having a smooth surface except for the regions of the friction surfaces 14', 36', 40', 44'. The friction surfaces 14', 36', 40', 44' can include a non-abrasive friction element to provide an increased friction coefficient when rubbing against the first portion 30 and second portion 32 of the garment. Friction surfaces can also be arranged on an interior of the first bend 22 and second bend 26 to provide improved gripping ability. In other embodiments, friction surfaces or friction elements can include tines, which are described in more detail below with respect to FIGS. 5A-10B.

In another embodiment, the dimpled portion 34 of the first bend 22 can include a magnetic material such that the dimpled portion 34 of the first bend 22 is magnetically attracted to the first portion 18.

Figure 2A:
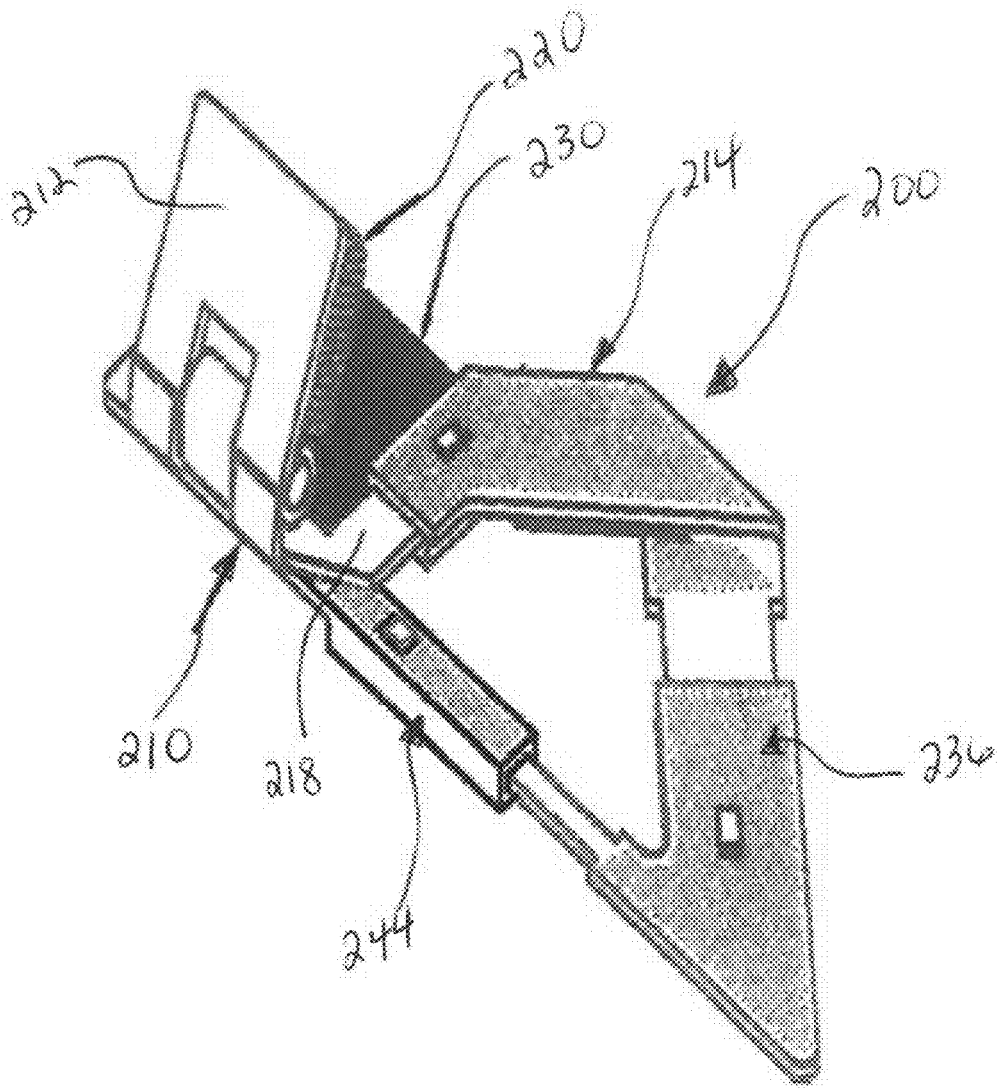
FIG. 2A shows a perspective view of a garment device according to a second embodiment with a hinged plate in an open configuration.
Figure 2B:
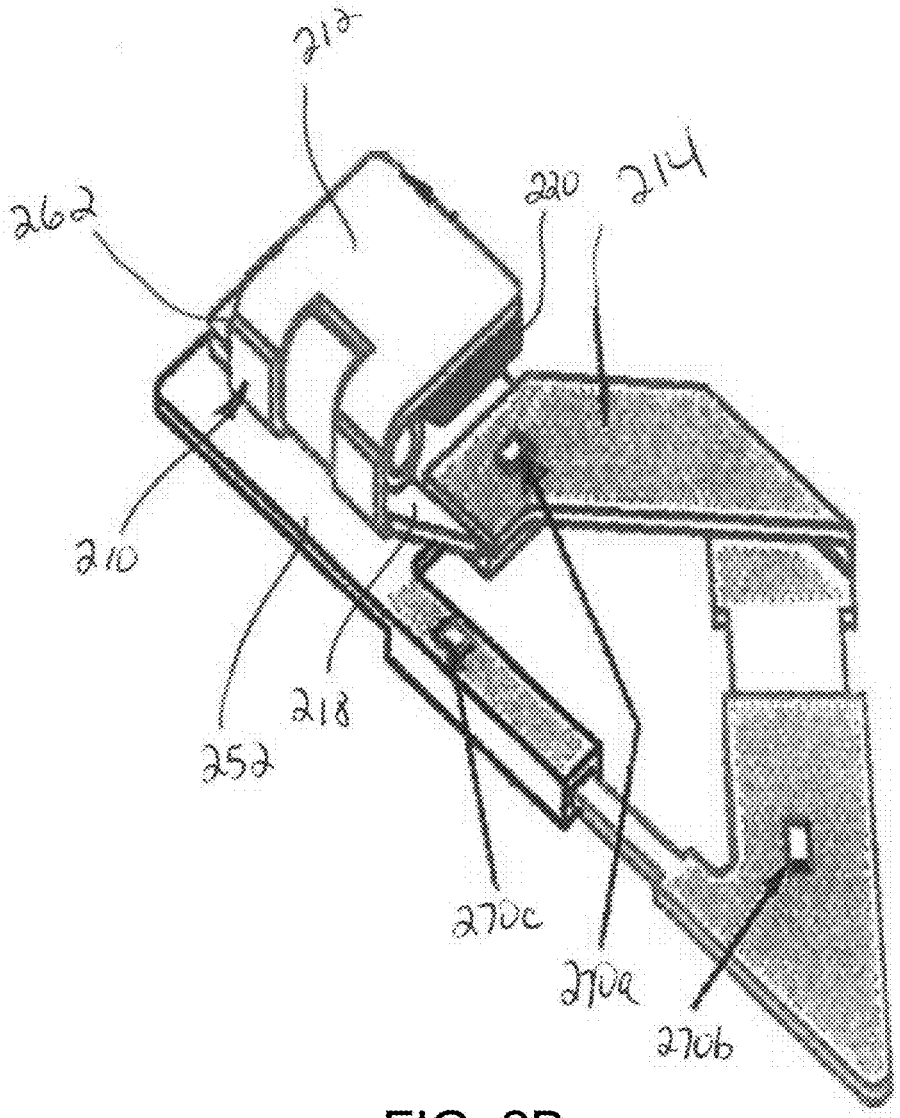
FIG. 2B shows a perspective view of the garment device of FIG. 2A with the hinged plate in a closed configuration.
Figure 2C:
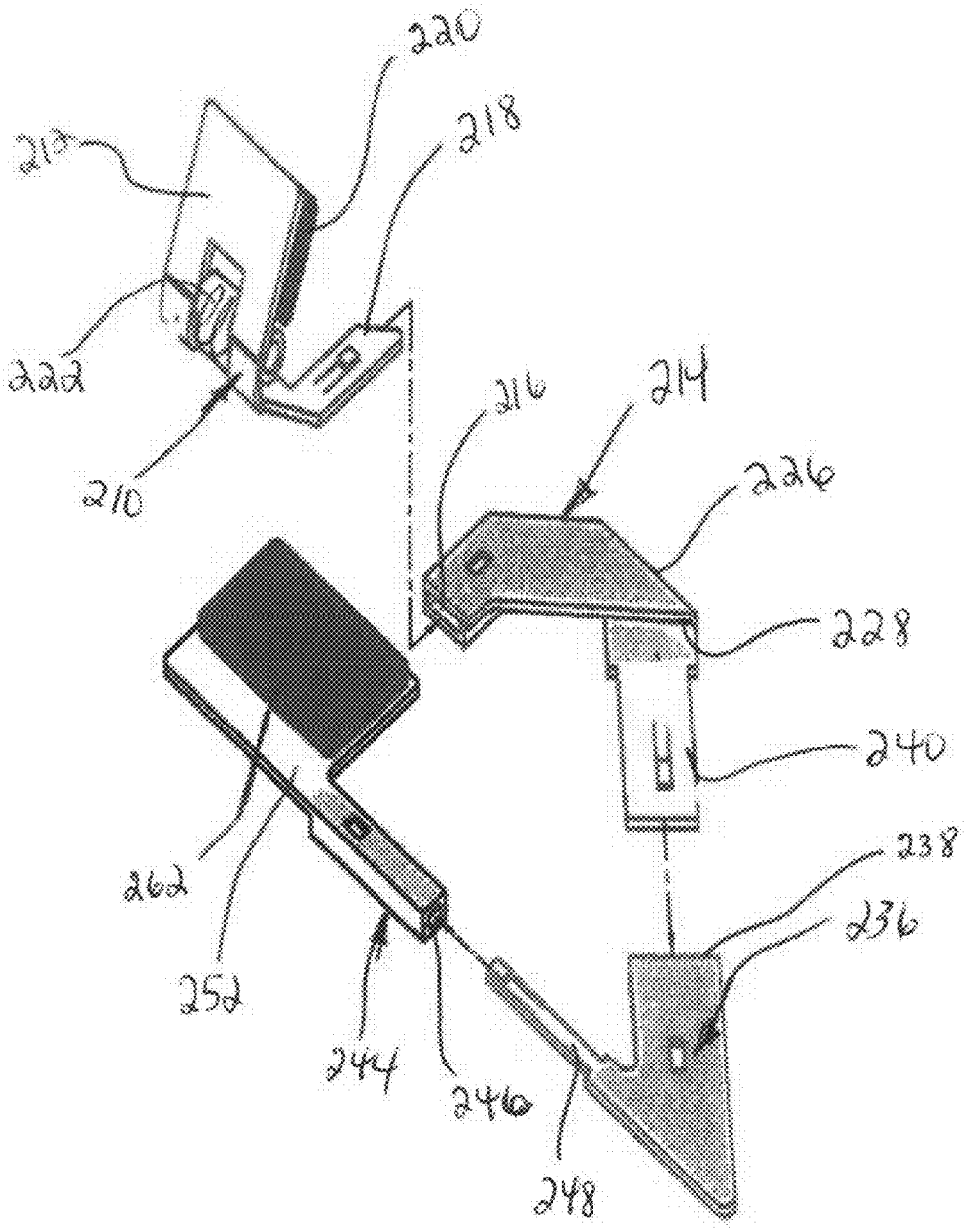
FIG. 2C shows an exploded perspective view of the garment device of FIGS. 2A and 2B.

FIGS. 2A-2D show a second embodiment of a garment closing device 200 that is similar to the first embodiment of the garment closing device 10. The device 200 includes a first arm 214, a second arm 236, and a third arm 244 including similar features as described above with respect to the first embodiment 10. The garment closing device 200 includes a first portion 218 of the first arm 214 having a hinged assembly 210 including a hinged plate 212 with a first magnet 220. A spring 222 inside the hinged assembly 210 biases the hinged plate 212 to a closed position shown in FIGS. 2B and 2D. A user can then pry the hinged assembly 210 open, as shown in FIGS. 2A and 2C, to allow for insertion of a portion 230, 232 of a garment.

Figure 2D:
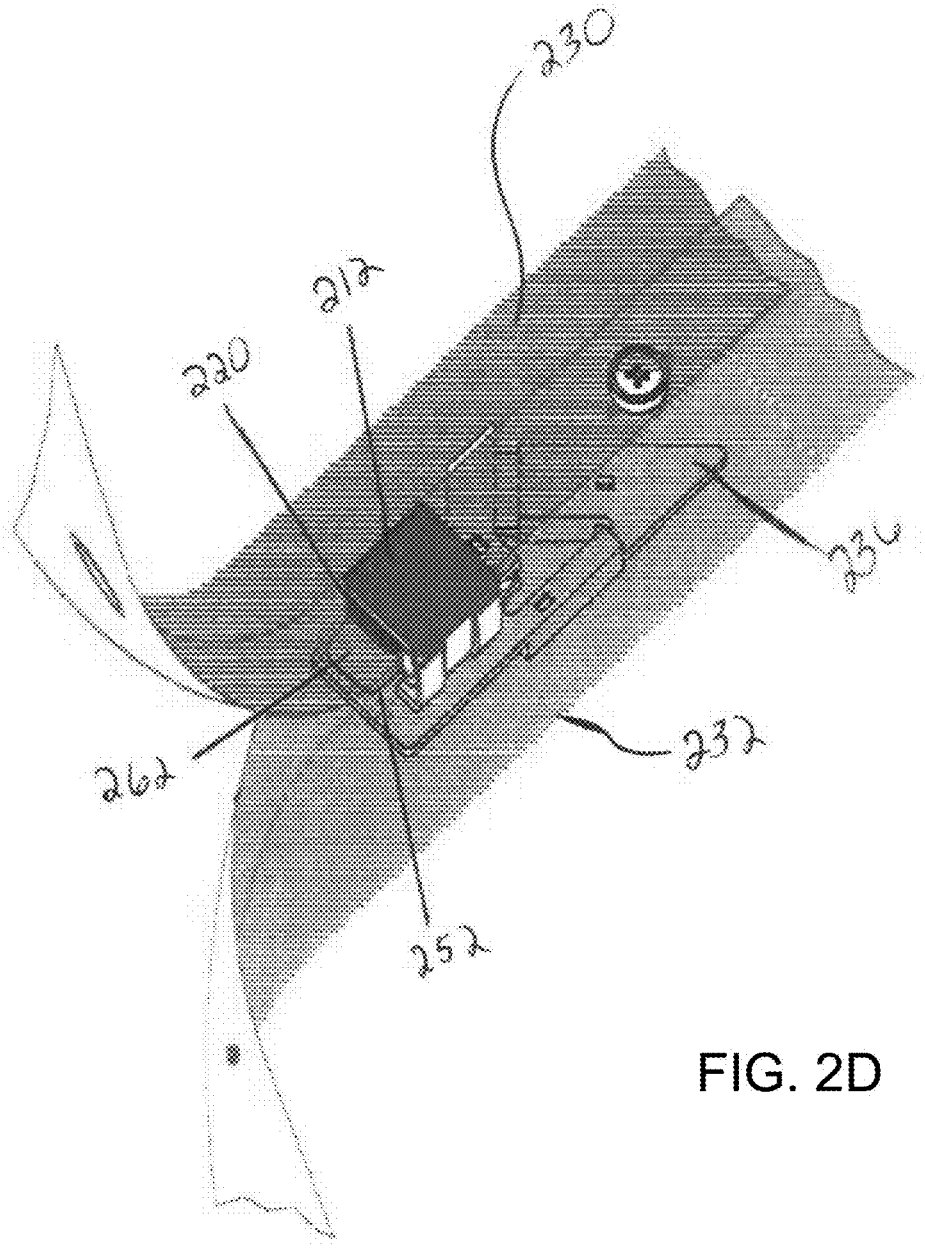
FIG. 2D shows a perspective view of the garment device of FIGS. 2A-2C in an installed state on a garment.

Similar to the first embodiment, the first arm 214 of the second embodiment of the device 200 includes a first portion 218 which is slidably received within a first sleeve 216. The first portion 218 of the first arm 214 includes the hinged plate 212 with the first magnet 220, the first arm 214 includes a first bend 226 that bends away from the hinged plate 212 to define a gap 228, and a second portion 240 of the first arm 214 extends away from the gap 228. The second arm 236 includes a second sleeve 238 and the second portion 240 of the first arm 214 is slidably received within the second sleeve 238 of the second arm 236. The third arm 244 includes a third sleeve 246 and a second portion 248 of the second arm 236 is slidably received within the third sleeve 246 of the third arm 244. In an assembled state, as shown in FIGS. 2A, 2B, and 2D, a first portion 252 of the third arm 244 overlaps with the first portion 218 of the first arm 214. The first portion 252 of the third arm 244 includes a second magnet 262 that directly faces and overlaps the first magnet 220 of the first portion 218 of the first arm 214. As shown in FIG. 2D, the first magnet 220 on the hinged plate 212 of the first arm 214 is biased closed against the second magnet 262 of the third arm 244 to grip a first portion 230 of a garment and the first bend 226 of the first arm 214 is dimensioned to grip a second portion 232 of a garment. The first magnet 220 is biased closed to abut against the second magnet 262 after the first portion 230 of the garment is slid between the first magnet 220 and the second magnet 262 such that the device 200 is retained with respect to the garment. Additional magnets are described in more detail below with respect to FIGS. 5A-8B, 10A, and 10B.

As shown in FIG. 2B, the device 200 includes adjustment mechanisms 270*a*, 270*b*, and 270*c*, which are similar to the adjustment mechanisms 70*a*, 70*b*, 70*c* of the first embodiment of the device 10. The adjustment mechanisms 270*a*, 270*b*, 270*c* similarly allow for adjustment of lengths of the arms 214, 236, 244 of the device 200 in the lateral (X) and longitudinal (Y) directions as described above.

A third embodiment of a garment closing device 300 is shown in FIGS. 3A-3D. The device 300 has a generally straight profile compared to the triangular profiles of the devices 10, 200. The garment closing device 300 includes a housing 310 with a first bend 320 bending forwards, and an arm 340 with a second bend 350 bending backwards. The device 300 achieves the same v-shaped neckline for a garment having a first and second portion 330, 332 by arranging the first portion 330 of the garment within the first bend 320 and the second portion 332 of the garment within the second bend 350, similar to the configuration described above with respect to the first and second embodiments of the devices 10, 200. As shown in FIGS. 3A-3D, the housing 310 includes the first bend 320 which defines a gap 322 dimensioned to grip the first portion 330 of the garment, and the arm 340 includes the second bend 350 which defines a gap 352 dimensioned to grip the second portion 332 of the garment.

Figure 3A:
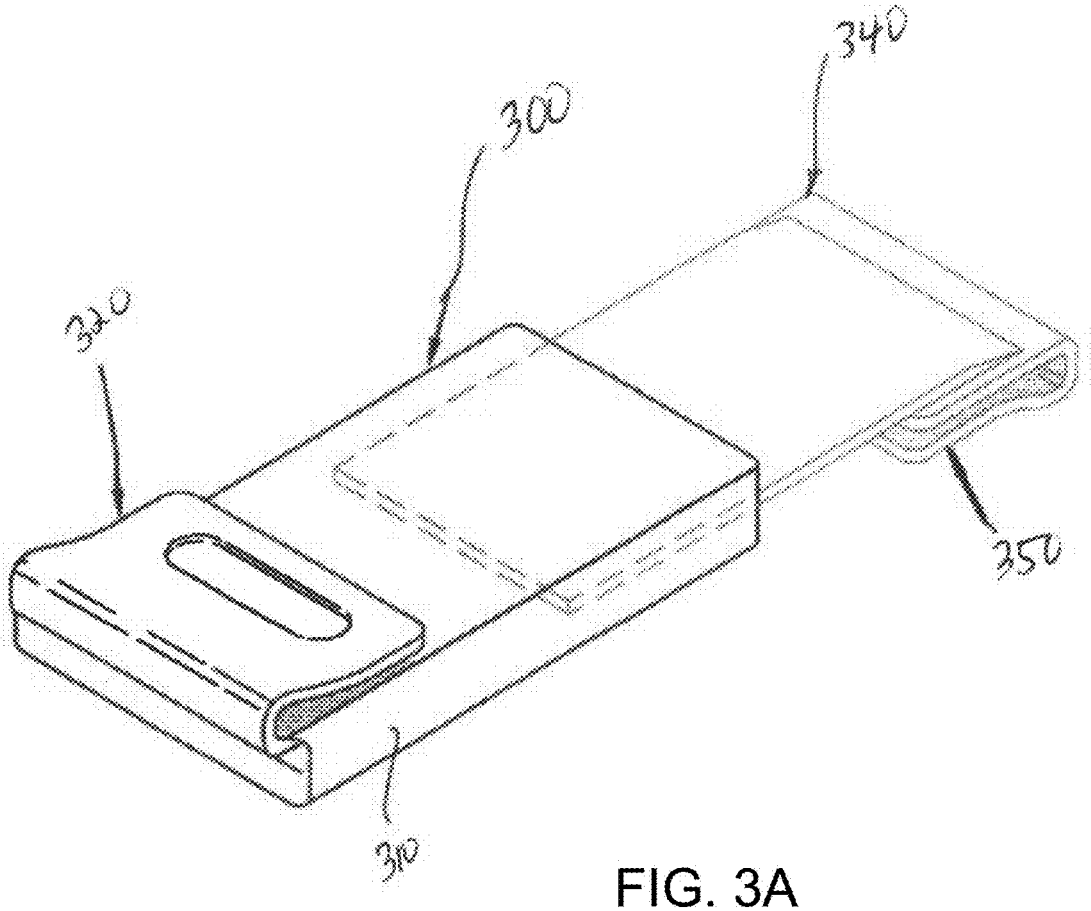
FIG. 3A shows a perspective view of a garment device according to a third embodiment.
Figure 3B:
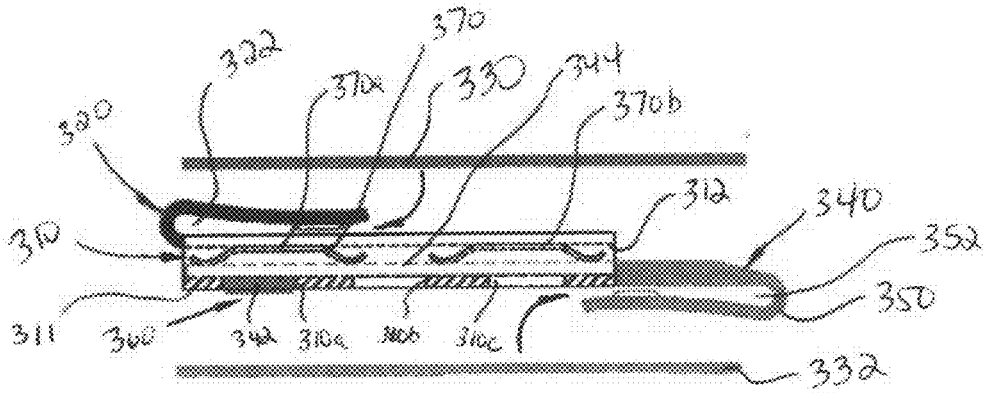
FIGS. 3B-3D show cross sectional views of the garment device of FIG. 3A with an adjustment mechanism is different positions.
Figure 3C:
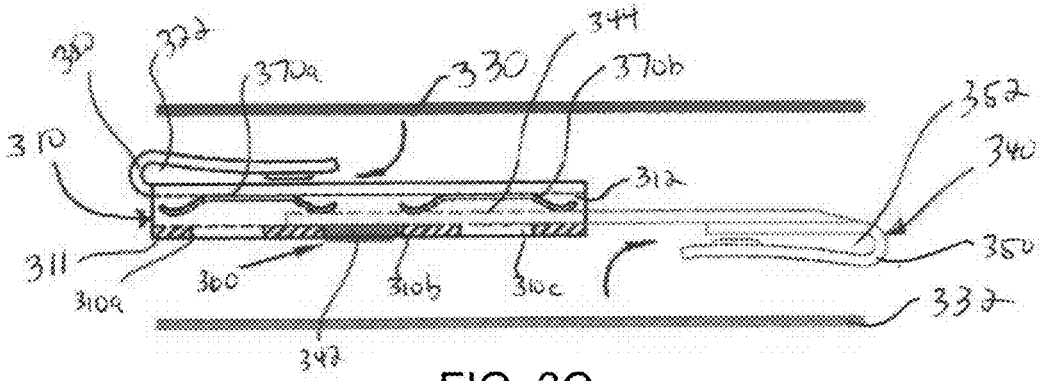

An adjustment mechanism 360 is provided that allows the arm 340 to be slidably positioned within the housing 310. The adjustment mechanism 360 preferably includes a plurality of openings 310*a*, 310*b*, 310*c* defined on a back face 311 of the housing 310. The housing 310 includes at least one biasing element 370 arranged in an interior 312 of the housing 310. The adjustment mechanism 360 also preferably includes a protrusion 342 defined on a first portion 344 of the arm 340 received within the housing 310. The protrusion 343 is dimensioned to be within each of the openings 310*a*, 310*b*, 310*c* of the housing 310. A user manually presses the protrusion 343 inward with respect to the housing 310 such that the protrusion 343 is recessed within the housing 310 and slides the arm 340 inward or outward with respect to the housing 310. The at least one biasing element 370 biases the protrusion 343 outward with respect to the housing 310 such that the protrusion 343 is captively retained with one of the openings 310*a*, 310*b*, 310*c* of the housing 310. The at least one biasing element 370 preferably includes two plate springs 370*a*, 370*b* arranged adjacent to each other. Arrows in FIGS. 3B-3D show an insertion direction for the portions 330, 332 of the garment into the gaps 322, 352, respectively.

Figure 3D:
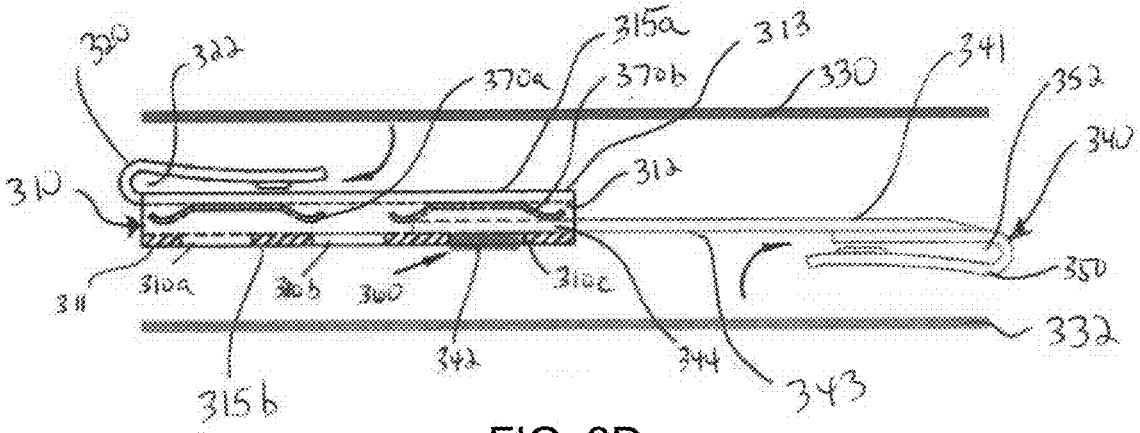

As shown in FIG. 3D, the back face 311 and a front face 313 of the housing 310 each preferably include an increased friction coating or surface 315*a*, 315*b*. The increased friction coating or surface 315*a*, 315*b* is similar to the friction surfaces 14', 36', 40', 44' of the first embodiment described above. The friction coating or surface 315*a*, 315*b* is provided to improve gripping against the garment once inserted into the device 300. The increased friction coating or surface 315*a*, 315*b* has increased friction compared to adjacent surfaces that are non-treated with increased friction materials or processing. A front surface 341 and back surface 343 of the arm 340 can also include an increased friction surface.

Figure 4A:
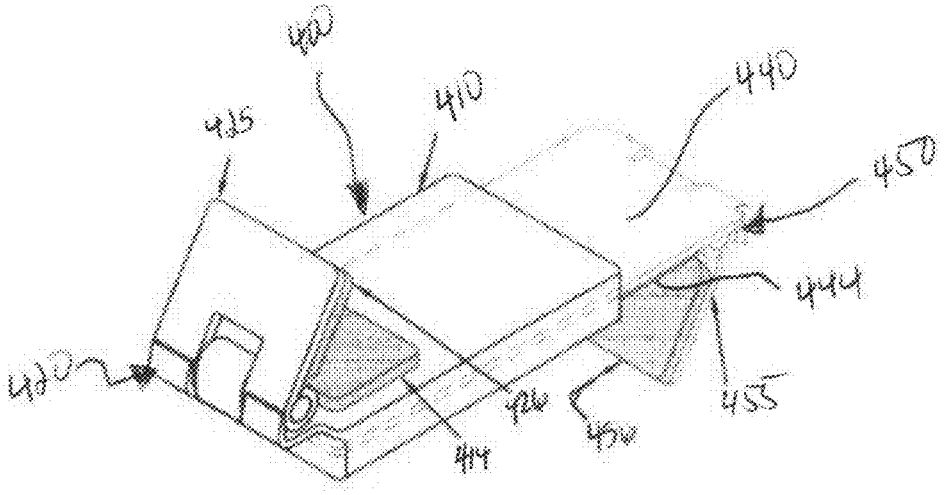
FIG. 4A shows a perspective view of a garment device according to a fourth embodiment.
Figure 4B:
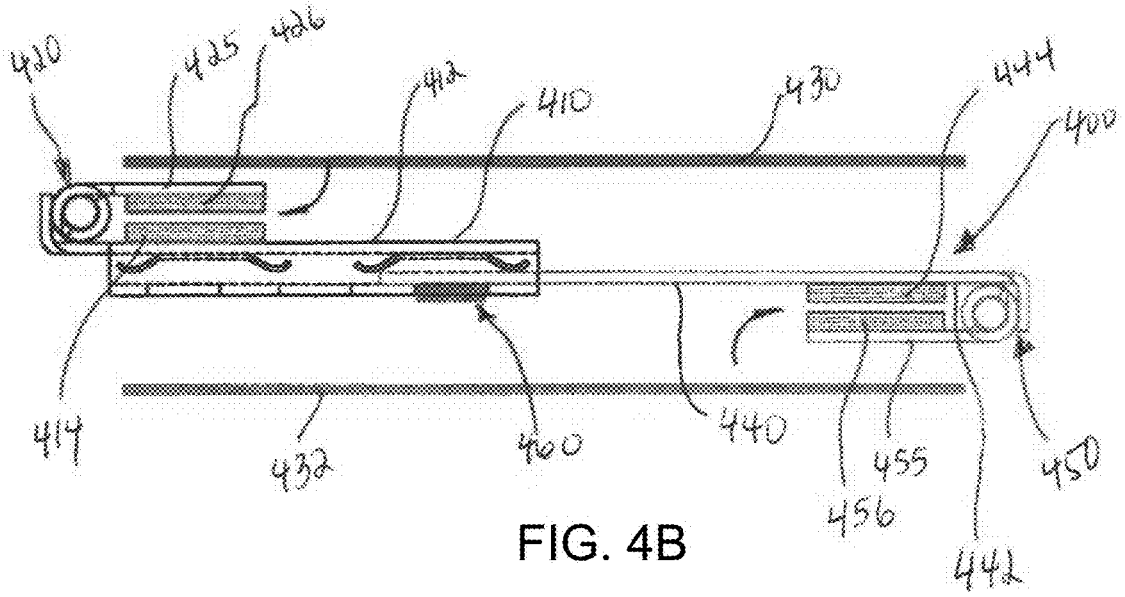
FIG. 4B shows a cross sectional view of the garment device of FIG. 4A.

A fourth embodiment of a garment closing device 400 is illustrated in FIGS. 4A and 4B. The device 400 is similar to the third embodiment of the garment closing device 300 described above except the bends 320, 350 of the device 300 are replaced with hinged assemblies 420, 450 in the device 400 of FIGS. 4A and 4B. A first and second hinged assembly 420, 450 each include a respective first and second hinged plate 425, 455 having a respective magnet 426, 456. The first hinged assembly 420 is arranged on a front face 412 of the housing 410, and the second hinged assembly 450 is arranged on a rear face 442 of the arm 440. The front face 412 of the housing 410 includes a housing magnet 414 that directly faces the first magnet 426 of the first hinged assembly 420. The first hinged plate 425 is biased closed and towards the housing 410 such that the first magnet 426 of the first hinged assembly 420 abuts the housing magnet 414 to grip a first portion 430 of a garment. An arm magnet 444 is arranged on the rear face 442 of the arm 440 that directly faces the second magnet 456 of the second hinged assembly 450. The second hinged plate 455 is biased closed and towards the arm 440 such that the second magnet 456 of the second hinged assembly 450 abuts the arm magnet 444 to grip a second portion 432 of a garment. The hinged assemblies 420, 450 of the device 400 are similar to the hinged assembly 210 of FIGS. 2A-2D and can similarly include an internal spring to bias the plates in a closing direction. An adjustment mechanism 460 is also provided that is similar to the adjustment mechanism 360 of the third embodiment. The adjustment mechanism 460 allows the arm 440 to be slidably adjusted with respect to the housing 410 as described above.

One of ordinary skill in the art recognizes that the housing 410 and arm 440 of the fourth embodiment can similarly include increased friction surfaces as described above with respect to the third embodiment to improve the gripping ability of the device 400 with respect to the garment.

Figure 5A:
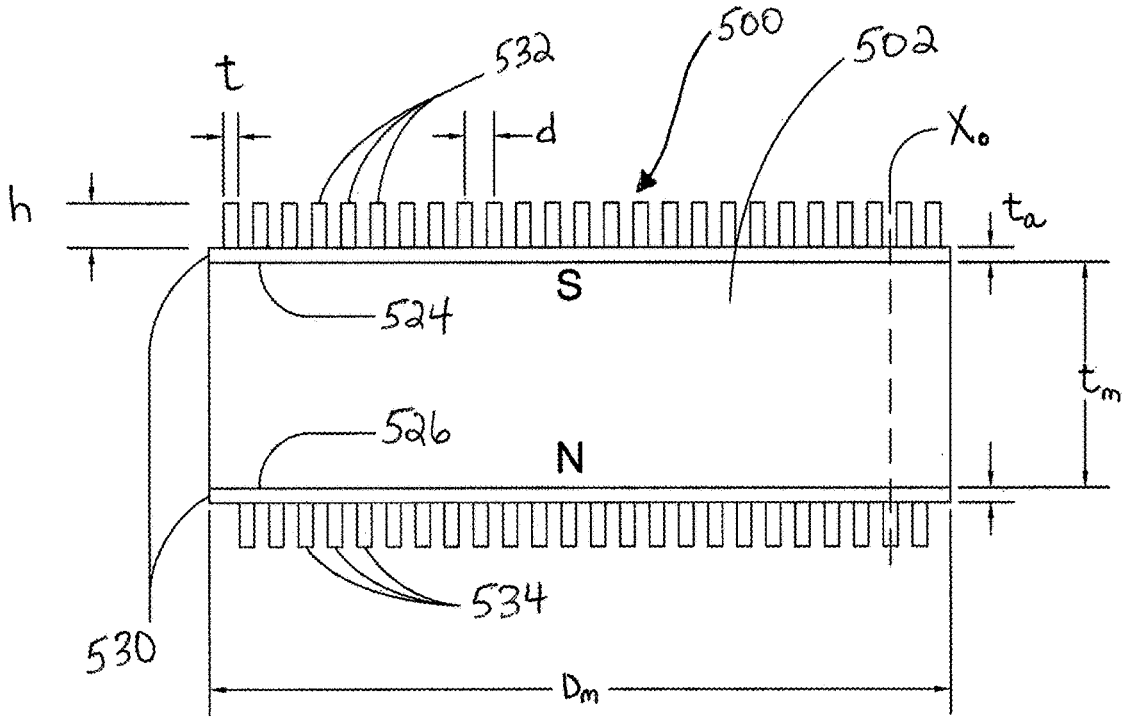
FIG. 5A is a side view of a clamping device according to a fifth embodiment.
Figure 5B:
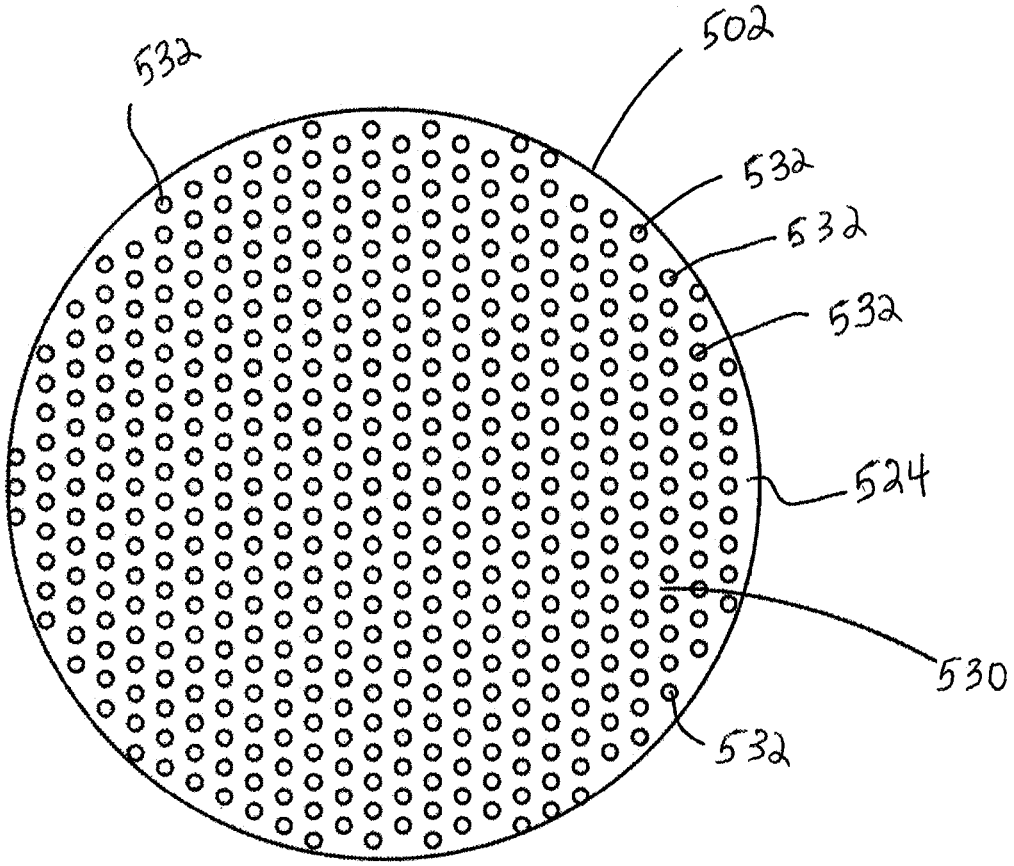
FIG. 5B is a top plan view of the clamping device of FIG. 5A.

In a fifth embodiment shown in FIGS. 5A and 5B, a clamping device 500 is illustrated. The clamping device 500 includes a magnet 502 including a south pole surface 524 and a north pole surface 526. In one embodiment, the magnet 502 has a thickness ($t_m$) between 0.05 inches and 0.07 inches, and more preferably has a thickness ($t_m$) of 0.0625 inches. The magnet has a diameter ($D_m$) between 0.5 inches and 0.7 inches, and more preferably has a diameter ($D_m$) of 0.625 inches. One of ordinary skill in the art would recognize from the present disclosure that alternative shapes for the magnet 502 can be used, such as ring, semi-spherical, rectangle, square, etc. Alternative physical dimensions and magnetic grades for the magnets can be used. In one embodiment of the cylindrical magnet 502, the magnet has a diameter of 0.75 inches and a thickness of 0.0625 inches. In one embodiment, the magnet 502 is a N52 grade neodymium magnet.

In one embodiment, the surfaces 524, 526 include attachment layers 530. As shown in FIG. 5A, the attachment layers 530 cover the entire surface of the south pole surface 524 and the north pole surface 526. In one embodiment, the attachment layers 530 have a thickness ($t_a$) between 0.005 inches and 0.025 inches, and more preferably have a thickness ($t_a$) of 0.015 inches.

The attachment layers 530 can include an adhesive layer. The attachment layers 530 include a plurality of projections 532, 534, preferably tines 532, 534. In one embodiment, the attachment layer 530 is omitted, and the tines 532, 534 are attached directly to the magnet 502. For example, the tines 532, 534 can be fixed to the magnet 502 by chemical deposition, thermal bonding, or direct printing.

The tines 532, 534 preferably have a thickness (t) of less than 0.020 inches, and more preferably less than 0.010 inches. The tines 532, 534 have a height (h) between 0.020 inches and 0.040 inches, and more preferably have a height of at least 0.030 inches. The height (h) of the tines 532, 534 is preferably at least three times greater than the thickness (t) of the tines 532, 534. A distance (d) between center points of adjacent tines 532, 534 is preferably greater than the thickness (t) of the tines 532, 534. In one embodiment, the distance (d) is between 0.040 and 0.060 inches. The distance (d) is preferably 0.050 inches. The distance (d) between adjacent tines is at least twice the thickness (t) of a tine, and the distance (d) is more preferably at least four times greater than the thickness (t) of a tine. Increasing the distance between adjacent tines provides an enlarged clamping area for a clamped material.

As shown in FIG. 5A, the south pole surface 524 has a first profile and the north pole surface 526 has a second profile. The first profile and the second profile are offset from each other (shown by line ($X_O$) in FIG. 5A) such that when two of the clamping devices 500 are facing each other the plurality of tines 532 on the south pole surface 524 of a first one of the two clamping devices 500 are aligned with spaces between the plurality of tines 534 on the north pole surface 526 of a second one of the two clamping devices 500. This optimizes the pole alignment between the two magnets, which increases the pull force between the magnets and maximizes the combined magnetic attractive forces of the outside surfaces 524, 526.

In one embodiment, the magnet 502 is cylindrical, as most clearly shown in FIG. 5B. As shown in FIG. 5B, the tines 532 are arranged on the surface 524 with a waffle-like pattern. The tines 532 pattern preferably extends to an outer circumference of the magnet 502. The magnet 502 includes at least fifty tines 532. In a more preferred embodiment, the magnet 502 includes at least one hundred tines 532. The rows and columns of tines 532 are offset from each other to define a space between the tines 532. A pattern of the tines 534 on the opposite surface 526 of the magnet 502 is complementary to the pattern of the tines 532 shown in FIG. 5B. Another magnet can be provided including tines that mesh with the tines 532 shown in FIG. 5B, which is described in more detail below.

The height and flexibility of the tines 532, 534 are selected to ensure that magnetic attractive force between the clamping device 500 and an adjacent magnetic clamping device is essentially unaffected by the tines 532, 534. One of ordinary skill in the art recognizes that magnetically attractive forces between two magnetic elements is extremely high at close distances and drops precipitously as distance between the two magnetic elements increases. The tines 532, 534 have a low profile based on their height (h) and flexibility that allows the tines 532, 534 to compress when the clamping device 500 is magnetically attracted towards an adjacent magnetic clamping device. In one embodiment, the tines 532, 534 are flexible. In one embodiment, the tines 532, 534 have a flexural modulus of elasticity of less than 5.0 GPa. In one embodiment, the tines 532, 534 have a straight profile. In another embodiment, the tines 532, 534 have a curved terminal end. The tines 532, 534 are formed from a non-abrasive material. The tines 532, 534 are configured to provide a gripping force for a clamped material that does not damage or otherwise mar the clamped material. In one embodiment, the tines 532, 534 are formed from a plastic material. In one embodiment, the tines 532, 534 are formed from polyethylene. In another embodiment, the tines 532, 534 are formed from metal. In another embodiment, alternative friction elements instead of tines can be used. One of ordinary skill in the art recognizes that other non-abrasive friction elements can be used.

Figure 6A:
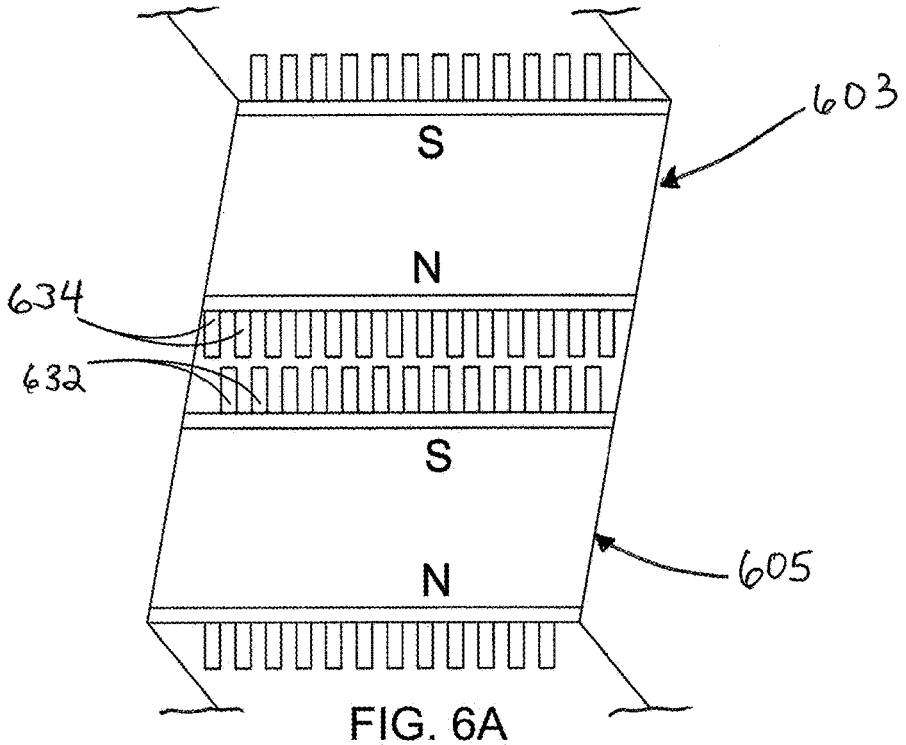
FIG. 6A is a side view of two clamping devices according to a sixth embodiment with flexible tines.
Figure 6B:
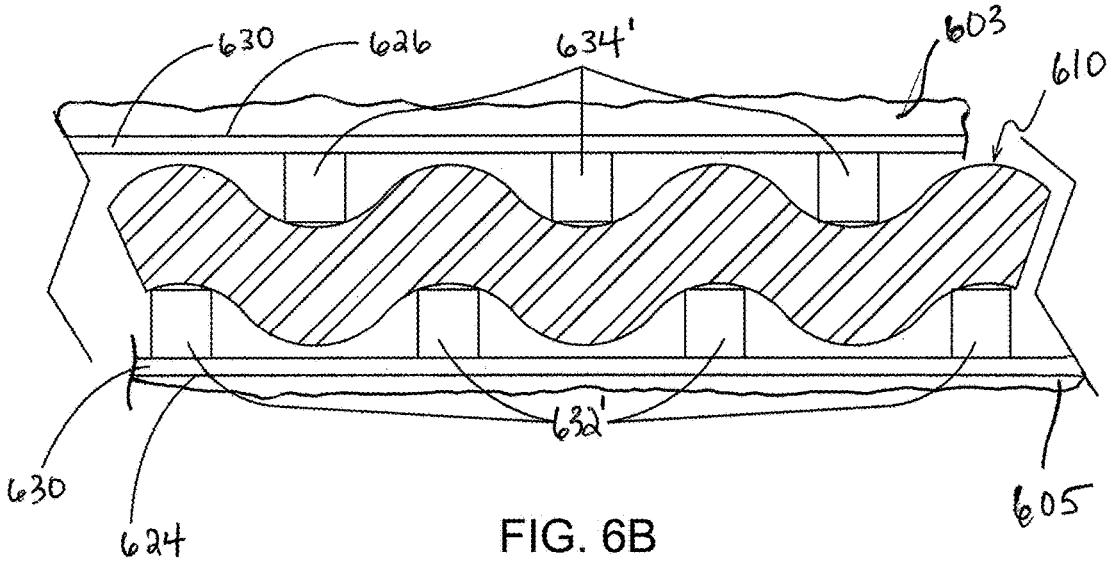
FIG. 6B is a side view of two of the clamping devices of FIG. 6A with a material layer between the clamping devices.

As shown in the cutaway view of FIG. 6A, a clamping device with attachment layers 630 including two magnets 603, 605 are provided with tines 632, 634 on a respective one of the magnets 603, 605 facing each other. A clamping area is defined between the two magnets 603, 605 in a region where the tines 632, 634 face each other. The magnets 603, 605 each have two predetermined side surface areas. The opposing tines 632, 634 are slightly offset from each other when the clamping devices 603, 605 are aligned, which allows for a material layer 610 (shown in FIG. 6B) to be gripped between the opposing tines. Alignment of the magnets in one embodiment requires alignment of an axis of each of the magnets. As shown in FIG. 6B, the material layer 610 is clamped between the two magnets 603, 605 such that the material layer 610 is held secure between the two magnets 603, 605. Although a single layer of the material layer 610 is shown in FIG. 6B, one of ordinary skill in the art would understand that multiple layers could be clamped between the magnets 603, 605. The opposing tines 632, 634 mesh with each other when the opposing polarities of the magnets 603, 605 are attracted to each other, and meshing of the tines 632, 634 restricts movement of the material layer 610 relative to the magnets 603, 605 as well as reduces the distance between the magnets 603, 605. The tines 632, 634 are shown in a non-compressed state in FIG. 6A, and the tines 632', 634' are shown in a compressed state in FIG. 6B. Although only two magnets 603, 605 are illustrated in FIG. 6A, one of ordinary skill in the art would understand that a plurality of magnets can be provided and stacked relative to each other.

Figure 6C:
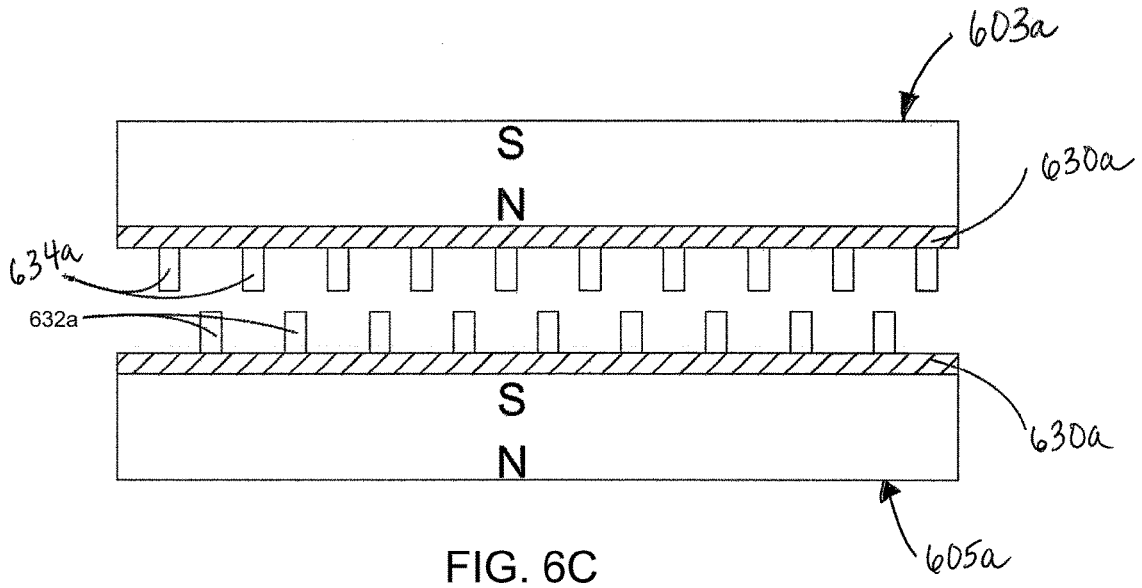
FIG. 6C is a side view of two clamping devices according to a sixth embodiment with rigid tines.
Figure 6D:
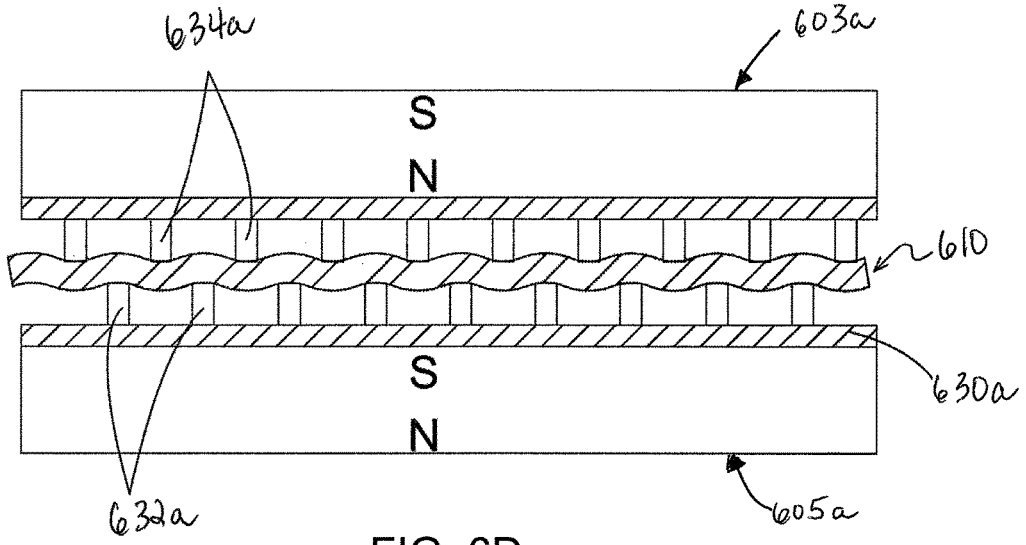
FIG. 6D is a side view of two of the clamping devices of FIG. 6C with a material layer between the clamping devices.

FIGS. 6C and 6D illustrate a pre-clamped state and a clamped stated for attachment layers 630*a* with magnets 603*a*, 605*a*, respectively. The magnets 603*a*, 605*a* are similar to the magnets of FIGS. 6A and 6B, except the tines 632*a*,634*a* have increased rigidity and do not compress or deform in the clamped position shown in FIG. 6D.

In a first loading case, the magnets 603, 605 are grade N52, have a diameter of 0.375 inches, a thickness of 0.0625 inches, and are spaced apart from each other by a distance of 0.020 inches. The distance between the magnets 603, 605 is dependent on a thickness of a material that is being clamped as well as the height of the tines 632, 634. In the first loading case, a pull force of 1.47 lbs. is exhibited between the two magnets 603, 605.

In a second loading case, a single magnet 603 is provided that has a grade N52, a diameter of 0.375 inches, a thickness of 0.0625 inches, and is spaced apart from a ferrous plate by a distance of 0.020 inches. In one embodiment, the ferrous plate is formed from steel. In the second loading case, a pull force of 1.28 lbs. is exhibited between the magnet 603 and the ferrous plate.

In a third loading case, the magnets 603, 605 are grade N52, have a diameter of 0.625 inches, a thickness of 0.0625 inches, and are spaced apart from each other by a distance of 0.020 inches. In the third loading case, a pull force of 3.06 lbs. is exhibited between the two magnets 603, 605.

In a fourth loading case, a single magnet 603 is provided that has a grade N52, a diameter of 0.625 inches, a thickness of 0.0625 inches, and is spaced apart from a ferrous plate by a distance of 0.020 inches. In the fourth loading case, a pull force of 2.92 lbs. is exhibited between the magnet 603 and the ferrous plate.

Figure 7A:
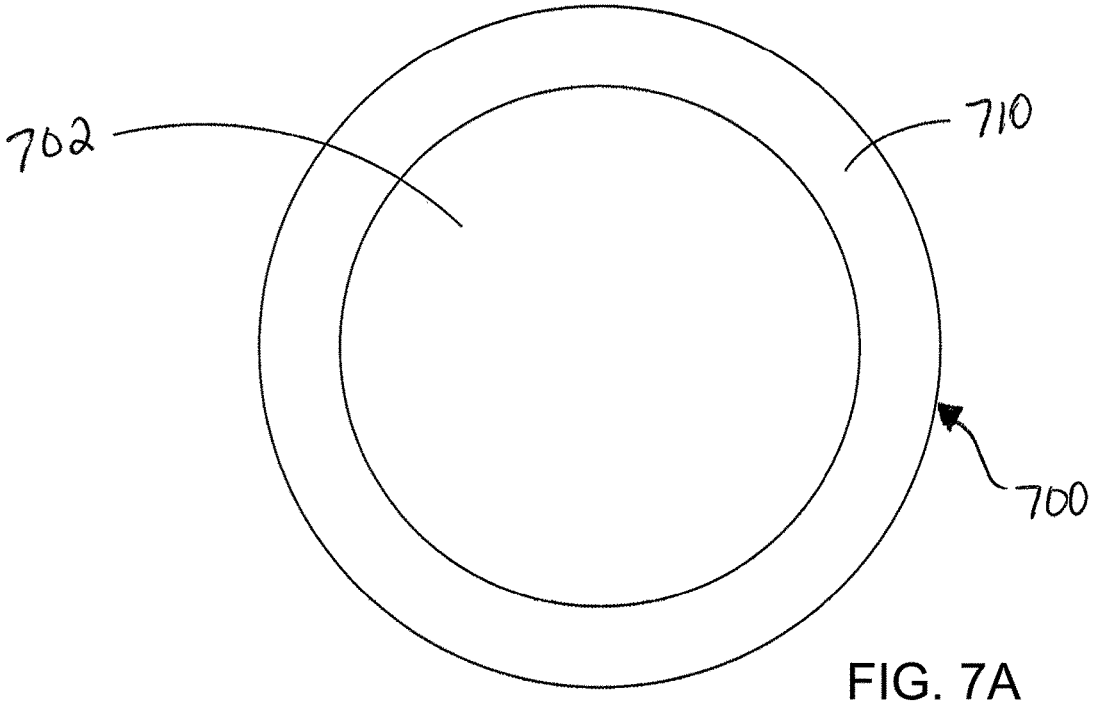
FIG. 7A is a top view of a clamping device according to a seventh embodiment.
Figure 7B:
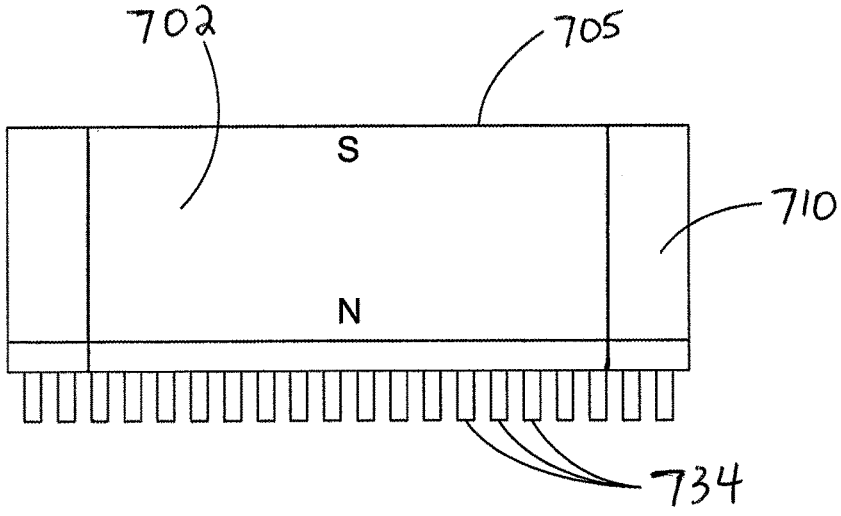
FIG. 7B is a side view of the clamping device of FIG. 7A.

FIGS. 7A and 7B illustrate another embodiment of a clamping device 700 that includes a housing 710 secured around the magnet 702. In this embodiment, a first magnetic surface 705 (south end) lacks tines, and a second magnetic surface (north end) includes tines 734. In another embodiment, the first magnetic surface 705 can also include tines. One of ordinary skill in the art would understand that alternative shapes and types of housing 710 can be provided for the magnets, or the housing can be omitted. The housing 710 can be formed from a non-ferrous material. The housing 710 preferably has a smooth outer surface to prevent irritation and abrasion of a user's skin and clothing. The housing 710 can include ornamental designs and/or shapes. In one embodiment, the housing 710 can include jewelry elements, such as diamonds or other ornamental stones.

Figure 8A:
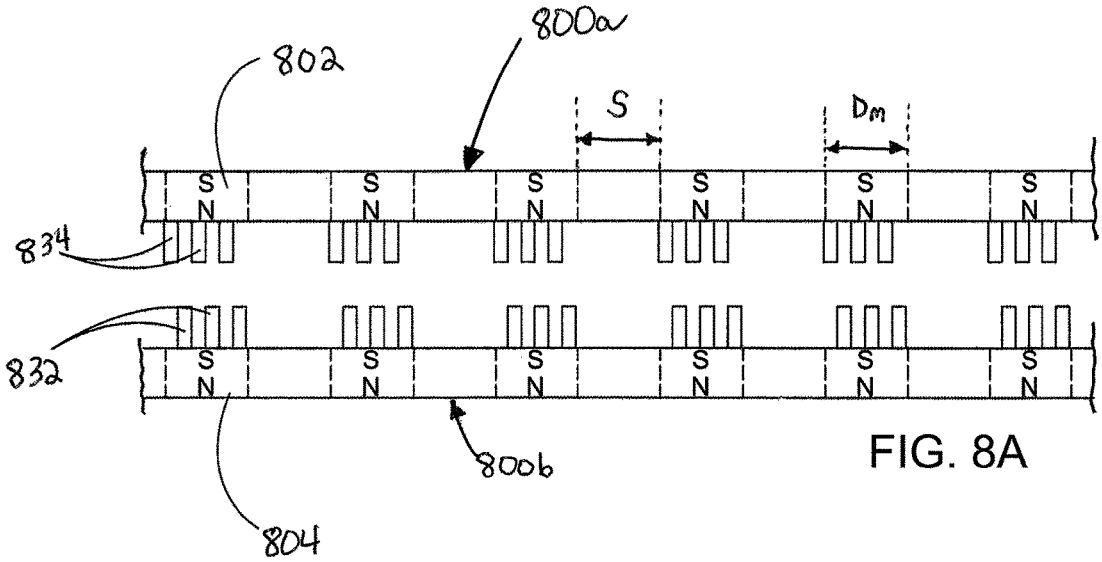
FIG. 8A is a side view of two strips of clamping devices according to an eighth embodiment.
Figure 8B:
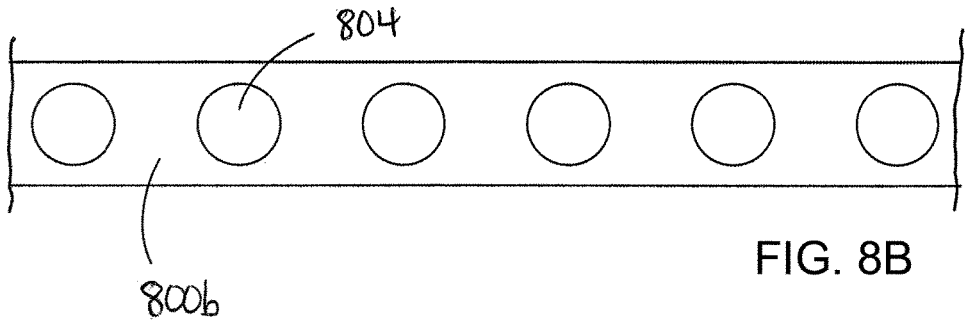
FIG. 8B is a top view one of the two strips of FIG. 8A.

FIGS. 8A and 8B illustrate an embodiment of the clamping device including multiple magnets 802 in strips 800*a*, 800*b*. Strip 800*a* includes a plurality of magnets 802 with tines 834 on a north pole surface, and strip 800*b* includes a plurality of magnets 804 including tines 832 on a south pole surface. The strips 800*a*, 800*b* can be aligned to face each other and the magnets 802, 804 are magnetically attracted to each other. The magnets 802, 804 can be embedded within the strips 800*a*, 800*b*, or can be otherwise attached to the strips 800*a*, 800*b*. The strips 800*a*, 800*b* can be incorporated into a belt, bracelet, or other type of garment or jewelry.

Figure 9A:
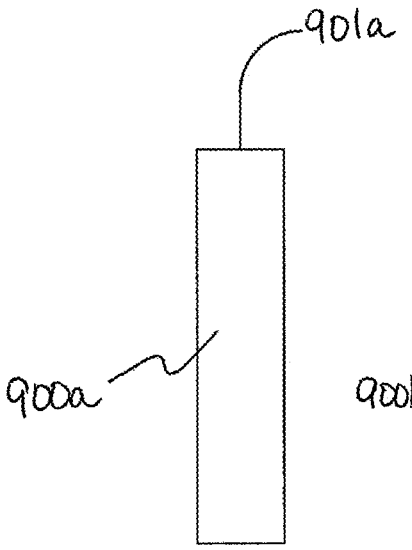
FIGS. 9A-9F illustrates multiple embodiments of tines.
Figure 9B:
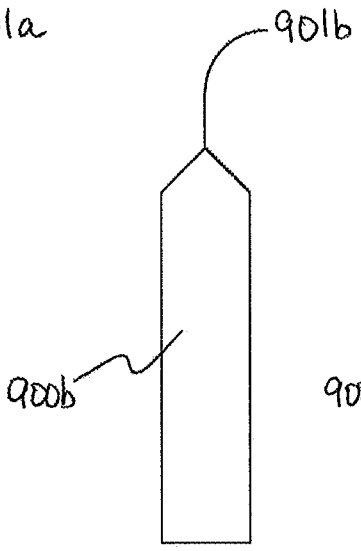
Figure 9C:
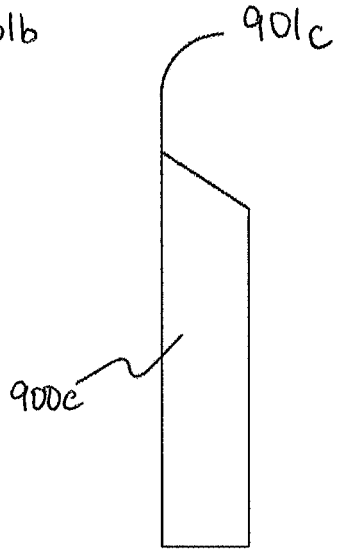
Figure 9D:
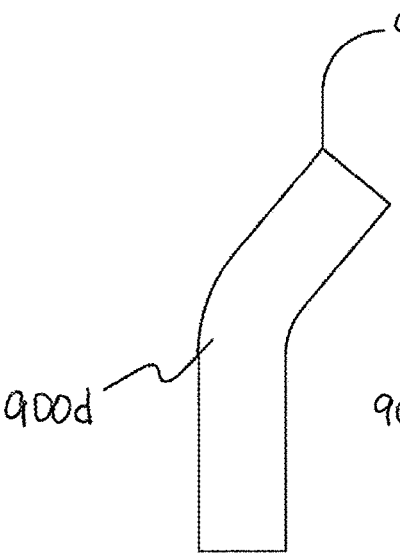
Figure 9E:
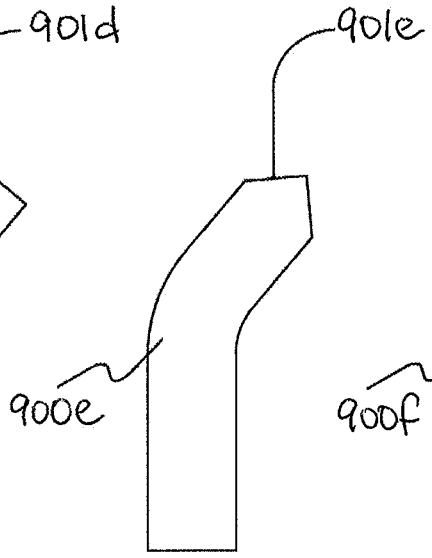
Figure 9F:
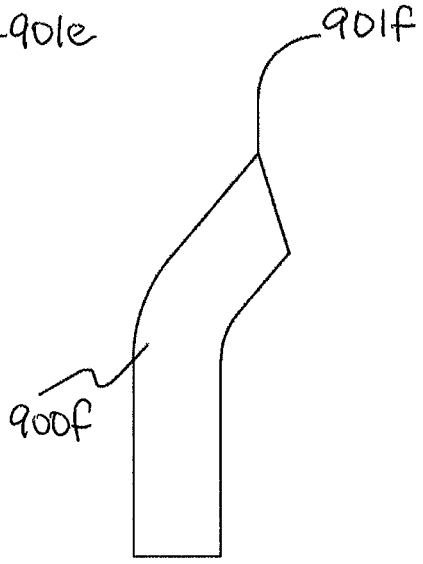

As shown in FIGS. 9A-9F, the individual tines 900 can have a variety of profiles. As shown in FIG. 9A, the tine 900*a* is cylindrical and has a straight profile with a flat tip 901*a*. In FIG. 9B, the tine 900*b* is cylindrical with a frusto-conical tip 901*b*. The tine 900*c* of FIG. 9C is cylindrical, with a straight profile and a slanted tip 901*c*. The tines of FIGS. 9D, 9E, and 9F are illustrated with a curved terminal end. In FIG. 9D, the tine 900*d* has a curved profile and a flat tip 901*d*. The tine 900*e* of FIG. 9E has a curved profile with a frusto-conical tip 901*e*. In FIG. 9F, the tine 900*f* has a curved profile and a slanted tip 901*f*. The tines 900 of FIGS. 9A-9F are shown in the non-clamped position, i.e. prior to engagement with a clamped material and application of any magnetically attractive force between their associated magnets. FIGS. 9D-9F show a bent or curved profile, which can be further bent or compressed during clamping. Tips 901*a*-901*f* illustrate a plurality of different contact profiles for material 610. The differing tip geometries produce slight friction indentations in the material 610, and the tips can temporarily engage with threads of the material 610. One of ordinary skill in the art would recognize from the present disclosure that other shapes and geometries can be used for the tines 900.

Figure 10A:
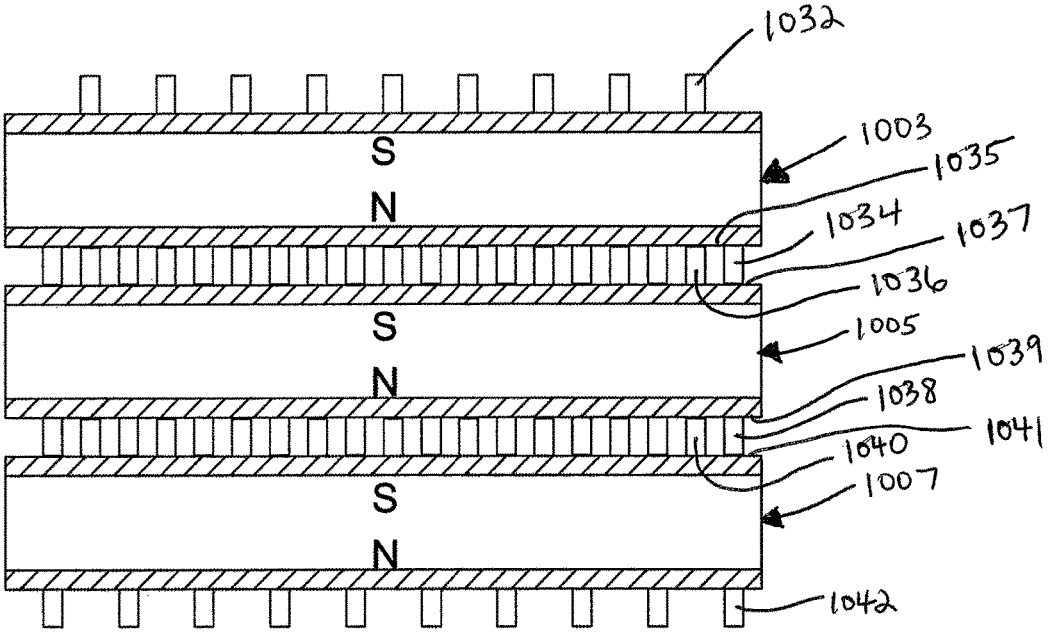
FIG. 10A is a side view of a stack of clamping devices.

FIG. 10A shows three stacked magnets 1003, 1005, 1007. Magnet 1003 includes tines 1032 on a surface facing away from the other magnets 1005, 1007, and tines 1034 on an opposite base surface 1035 that faces towards the other magnets 1005, 1007. The tines 1032, 1034 are offset from each other relative to an axis of the magnet 1003. The tines 1034 mesh with tines 1036 on the second magnet 1005. The tines 1034 of the first magnet 1003 fully mesh with the tines 1036 of the second magnet 1005, and the tines 1034 of the first magnet 1003 engage against a base surface 1037 of the second magnet 1005 while the tines 1036 of the second magnet 1005 engage against the base surface 1035 of the first magnet 1003. Similarly, tines 1038 on the second magnet 1005 mesh with tines 1040 of the third magnet 1007, and the tines 1038 on the second magnet 1005 engage a base surface 1041 of the third magnet 1007. The tines 1040 of the third magnet 1007 mesh with the tines 1038 of the second magnet 1005, and the tines 1040 of the third magnet 1007 engage against a base surface 1039 of the second magnet 1005. As shown in FIG. 10A, the magnets 1003, 1005, 1007 are configured to fully mesh with each other, such that the total distance between adjacent magnets 1003, 1005, 1007 is only limited by the height of the tines. The base surfaces

1035, 1037, 1039, 1041 can include indentations in the spacing between the tines to provided increased depth for penetration of the opposing tines into the base surfaces, which increases the requisite lateral force for separating the magnets.

Figure 10B:
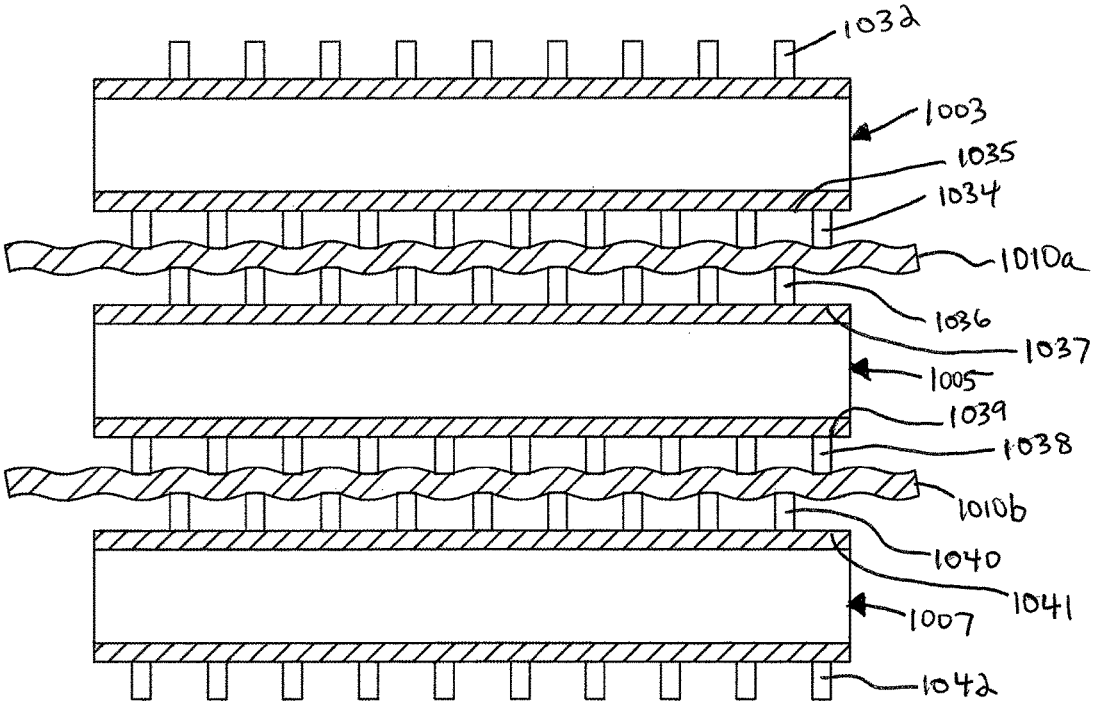
FIG. 10B is a side view of the stack of clamping devices of FIG. 10A with clamped material layers.

FIG. 10B illustrates the three magnets 1003, 1005, 1007 with two layers of material 1010*a*, 1010*b* arranged between the first magnet 1003 and the second magnet 1005, and the second magnet 1005 and the third magnet 1007, respectively. FIGS. 10A and 10B demonstrate the additional stacking ability of the magnets. The magnets can be stacked to achieve any desired strength, and the stacked magnets provide additive magnetic attractive forces. One of ordinary skill in the art would recognize from the present disclosure that any number of layers of material can be provided between adjacent magnets. In one embodiment, the middle magnet 1005 can be a ferrous plate. A thickness of the middle ferrous plate can be reduced compared to the required thickness of a magnet. In one embodiment, the thickness of the middle ferrous plate is less than 0.010 inches. The middle ferrous plate provides an increase in the pull force between end magnets 1003, 1007.

The magnets of FIGS. 5A-8B, 10A, and 10B can be incorporated into any one or more of the embodiments of FIGS. 1A-4B. Similarly, the tines of any one of the embodiments of FIGS. 5A-10B can be incorporated into any one or more of the embodiments of FIGS. 1A-4B. One of ordinary skill in the art would recognize from the present application that any one of the features from the devices in FIGS. 1A-10B can be used in any one of the other embodiments. Any one of the magnets described herein can be used by itself in a free form manner. Additionally, any single one of the magnets described herein can be attracted to a backing plate or other ferrous material element.

Having thus described various embodiments of the present devices in detail, it will be appreciated and apparent to those skilled in the art that many changes, only a few of which are exemplified in the detailed description above, could be made in the devices according to the invention without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

What is claimed is:

1. A clamping device comprising:

a first magnet with predetermined first and second side surface areas;

a first friction element on at least one of the first or second side surface areas;

a second magnet with predetermined third and fourth side surface areas; and a second friction element on at least one of the third or fourth side surface areas;

wherein the first friction element of the first magnet and the second friction element of the second magnet are arranged opposite to each other and define a clamping area between the first magnet and the second magnet, wherein the first friction element includes a first plurality of tines and the second friction element includes a second plurality of tines, and the first plurality of tines and the second plurality of tines are flexible and are each configured to compress when the first magnet and the second magnet clamp a material layer.

2. The clamping device of claim 1, wherein the first plurality of tines define a first profile, and the second plurality of tines define a second profile, and the first profile and the second profile are different from each other.

3. The clamping device of claim 2, wherein the first profile and the second profile are offset relative to each other when the first magnet is aligned with the second magnet.

4. The clamping device of claim 1, wherein a distance between adjacent tines of the first plurality of tines is greater than a thickness of an individual tine of the first plurality of tines.

5. The clamping device of claim 1, wherein the first plurality of tines includes at least fifty tines arranged at a uniform spacing from each other.

6. The clamping device of claim 1, wherein at least one of the first plurality of tines or the second plurality of tines has a preformed bent terminal end.

7. The clamping device of claim 1, wherein tines of at least one of the first plurality of tines or the second plurality of tines include a frusto-conical tip.

8. The clamping device of claim 1, wherein tines of at least one of the first plurality of tines or the second plurality of tines includes an angled tip.

9. The clamping device of claim 1, wherein the first magnet and the second magnet are each a neodymium magnet.

10. The clamping device of claim 1, wherein the first plurality of tines fully mesh with the second plurality of tines such that the first plurality of tines contact one of the third and fourth side surface areas, and the second plurality of tines contact one of the first and second side surface areas.

11. The clamping device of claim 1, wherein the first and second side surface areas each include the first plurality of tines, and the first plurality of tines on the first side surface area is offset relative to the first plurality of tines on the second side surface area.

12. The clamping device of claim 1, wherein the first plurality of tines cover an entire area of the at least one of the first and second side surface areas.

13. The clamping device of claim 1, wherein the first plurality of tines define a first profile, and the second plurality of tines define a second profile, and the first profile and the second profile are different from each other, the first profile and the second profile are offset relative to each other when the first magnet is aligned with the second magnet, the first plurality of tines and the second plurality of tines each include at least fifty tines arranged at a uniform spacing from each other, and a distance between adjacent tines of the first plurality of tines is greater than a thickness of an individual tine of the first plurality of tines.

14. A garment closing mechanism including the clamping device of claim 1, wherein the garment closing mechanism comprises a plurality of adjustable arms, and at least one of the plurality of adjustable arms includes a clamp with the first magnet and the second magnet.

15. A clamping device comprising:

a first magnet with predetermined first and second side surface areas;

a first friction element on at least one of the first or second side surface areas;

a second magnet with predetermined third and fourth side surface areas; and a second friction element on at least one of the third or fourth side surface areas, the first friction element of the first magnet and the second friction element of the second magnet are arranged opposite to each other and define a clamping area between the first magnet and the second magnet, and a third magnet arranged between the first magnet and second magnet, the third magnet including a third friction element.

16. The clamping device of claim 15, wherein the first friction element includes a first plurality of tines and the second friction element includes a second plurality of tines.

17. The clamping device of claim 16, wherein the first plurality of tines and the second plurality of tines are flexible and are each configured to compress when the first magnet and the second magnet clamp a material layer.

18. The clamping device of claim 16, wherein the first plurality of tines and the second plurality of tines are inflexible.

19. A clamping device comprising:

a first magnet with predetermined first and second side surface areas;

a first friction element on at least one of the first or second side surface areas;

a second magnet with predetermined third and fourth side surface areas; and a second friction element on at least one of the third or fourth side surface areas;

wherein the first friction element of the first magnet and the second friction element of the second magnet are arranged opposite to each other and define a clamping area between the first magnet and the second magnet, wherein at least one of the first magnet or the second magnet is enclosed in a housing, and the housing includes a decorative element.

* * * * *